US007314415B2

(12) United States Patent
Umemura

(10) Patent No.: US 7,314,415 B2
(45) Date of Patent: Jan. 1, 2008

(54) COUPLING MEMBER

(75) Inventor: Yukio Umemura, Yokohama (JP)

(73) Assignee: Calsonic Kansei Corporation, Tokyo (JP)

( * ) Notice: Subject to any disclaimer, the term of this patent is extended or adjusted under 35 U.S.C. 154(b) by 230 days.

(21) Appl. No.: 10/529,151

(22) PCT Filed: Jul. 16, 2004

(86) PCT No.: PCT/JP2004/010536

§ 371 (c)(1),
(2), (4) Date: Mar. 24, 2005

(87) PCT Pub. No.: WO2005/008093

PCT Pub. Date: Jan. 27, 2005

(65) Prior Publication Data

US 2006/0046857 A1 Mar. 2, 2006

(30) Foreign Application Priority Data

Jul. 18, 2003 (JP) ..... 2003-276723
Mar. 22, 2004 (JP) ..... 2004-083478

(51) Int. Cl.
*F16D 7/04* (2006.01)

(52) U.S. Cl. ..... 464/37; 24/545

(58) Field of Classification Search ..... 24/115 F, 24/602, 545–547; 464/32, 37; 474/70, 236, 474/902; 59/85, 91
See application file for complete search history.

(56) References Cited

U.S. PATENT DOCUMENTS 1,590,172 A * 6/1926 Thorberg ..... 24/546 X
2,673,633 A * 3/1954 Miller et al.
3,847,031 A * 11/1974 Araya
4,574,930 A 3/1986 Koitabashi
4,617,775 A * 10/1986 Padrun ..... 24/545 X
5,427,559 A * 6/1995 Glickman et al. ..... 59/85 X (Continued)

FOREIGN PATENT DOCUMENTS

EP 1 207 316 A1 5/2002

(Continued)

OTHER PUBLICATIONS

Patent Abstracts of Japan, vol. 1999, No. 01, Jan. 29, 1999, JP 10-267048, Oct. 6, 1998.

(Continued)

*Primary Examiner*—Greg Binda
(74) *Attorney, Agent, or Firm*—Foley & Lardner LLP

(57) ABSTRACT

A coupling member (18) is of a forked leaf spring which is substantially U-shaped and has a pair of sidepiece portions (18*a*, 18*a*), a pair of bent portions (18*b*, 18*b*), a pair of joining portions (18*d*, 18*d*) and a curved portion (18*e*). The sidepiece portions (18*a*, 18*a*) are disposed parallel to each other. The bent portions (18*b*, 18*b*) are configured to extend from the sidepiece portions (18*a*, 18*a*) and have sandwich portions (18*c*, 18*c*) releasably supporting a first pin (14) mounted on a pulley, respectively. Each sandwich portion (18*c*) has an inside surface (19*a*) which is opposed to the outside circumferential surface of the first pin (14) at a regular distance, and a first and second projections (19*b*, 19*c*) which are provided at both ends of the inside surface (19*a*) and contacted with the outside circumferential surface of the first pin (14).

10 Claims, 26 Drawing Sheets

U.S. PATENT DOCUMENTS 6,189,187 B1 * 2/2001 Williams ..... 24/545 X
2004/0086392 A1 * 5/2004 Umemura

FOREIGN PATENT DOCUMENTS

JP 2000-87850 A 3/2000

OTHER PUBLICATIONS

Patent Abstracts of Japan, vol. 2003, No. 09, Sep. 3, 2003 JP 2003-139161, May 14, 2003.
Patent Abstracts of Japan, vol. 1996, No. 09, Sep. 30, 1996, JP 8-121333, May 14, 1996.

* cited by examiner

COUPLING MEMBER

TECHNICAL FIELD

The present invention relates to a coupling member which couples a driven body with a driving body to transmit driving force of the driving body to the driven body, and cuts off the power transmission when a load for driving the driven body exceeds a given value.

BACKGROUND ART

A conventional power transmission device is disclosed in Japanese Patent Application Publication Laid-open No. 2000-87850, and is applied to a clutchless compressor. As shown in FIG. 1 a compressor 101 includes a housing 102, a rotary shaft 104 and a power transmission device 111. The housing 102 has an end portion at which a boss portion 103 is formed. The rotary shaft 104 has an end portion 104*a* which passes loosely through the boss portion 103. The boss portion 103 is coaxial with the rotary shaft 104.

The power transmission device 111 includes a bearing 112, a pulley 113, a cover member 114, a hub 115, a bolt 116, a washer 117, rivets 118, buffer rubbers 119 and rolling balls 120. The pulley 113 is rotatably held by the boss portion 103 via the bearing 112. The bearing 112 and the pulley 113 are coaxial with the rotary shaft 104. The pulley 113 has an external circumference on which a belt (not shown in the figure) is wound. The belt is coupled with a crankshaft (not shown) of an engine.

The cover member 114 is formed into the shape of a disk and is fixed via the hub 115 to the end portion 104*a* of the rotary shaft 104 with the bolt 116 and the washer 117. Further, the cover member 114 is fastened to the hub 115 with the rivets 118. The cover member 114 and the hub 115 are coaxial with the rotary shaft 104.

As shown in FIG. 2, the cover member 114 has a periphery on which plural recessed portions 114*a* are formed. The recessed portions 114*a* are disposed along the same circumference whose center coincides with the axis of the cover member 114. Each of the recessed portions 114*a* is located a regular angle apart from the adjacent ones 114*a*. The buffer rubbers 119 are formed nearly into the shape of a column and are fastened to the interior of the recessed portions 114*a* with an adhesive, respectively. The buffer rubber 119 has an end face 119*b*, protruding from the recessed portion 114*a*, where the end face 119*b* has a concave portion 119*a* for receiving one part of the rolling ball 120 slidably (refer to FIG. 1). Besides, a power-transmission cutoff member is composed of the buffer rubber 119 and rolling ball 120.

The pulley 113 has hole portions 113*a*, at the locations opposite to the concave portions 119*a*, for receiving the other part of the rolling balls 120 slidably. The hole portions 113*a* are disposed along the same circumference whose center coincides with the axis of the pulley 113. Each of the hole portions 113*a* is located a regular angle apart from the adjacent ones 113*a*. The depth of the hole portions 113*a* is designed such a depth that the rolling ball 120 can be surely released from the hole portion 113*a* when a torque-load larger than a given value is applied to the rolling ball 120.

Openings 113*b* are formed along the above circumference on which the hole portions 113*a* are disposed, and receive the rolling balls 120 released from the hole portions 113*a*. The depth of the openings 113*b* is larger than a diameter of the rolling balls 120.

When the engine is driven, power is transmitted via the belt to the power transmission device 111 and then rotates the pulley 113. Further, the power is transmitted via the rolling balls 120, the buffer rubbers 119, the cover member 114 and the hub 115 to the rotary shaft 104.

Once burn-in occurs in the interior of the compressor 101, the rotary shaft 104 stops rotating. Following the occurrence, the hub 115 and the cover member 114 also stop rotating, and therefore the numbers of revolutions of the pulley 113 and the cover member 114 come to differ from each other, resulting in that a torque load is applied to the buffer rubbers 119. When the torque load exceeds the given value, according to the application of the torque load to the rolling balls 120 via the buffer rubbers 119, the rolling balls 120 get out of the concave portions 119*a* against the holding force of the buffer rubbers 119 and are simultaneously released from the hole potions 113*a*. And then, the rolling balls 120 will enter into the interiors of the openings 113*b*. Since the power transmission from the pulley 113 to the rotary shaft 104 is cut off through the above mechanism, the pulley 113 will run idle.

However, when the power transmission from the pulley 113 to the rotary shaft 104 is cut off, it is necessary to release each rolling ball 120 from the concave portion 119*a* of the buffer rubber 119 and the hole portion 113*a* of the pulley 113 which cover the whole external circumference of the rolling ball 120. Therefore, the torque load required to cut off the power transmission varies to a large extent due to wear of the concave portion 119*a* and/or the hole portions 113*a*. Further, since the torque load is applied to the rolling ball 120 via the buffer rubber 119, the torque load required to cut off the power transmission varies to a large extent due to age-degradation of the buffer rubbers 119. As a result, the power transmission device 111 possesses lower reliability because the torque load required to cut off the power transmission varies each time the device is operated. Moreover, the assembling operation is laborious and the productivity is low because the rolling ball 120 should be disposed between the pulley 113 and the buffer rubber 119.

DISCLOSURE OF INVENTION

The object of the present invention is to provide a coupling member capable of cutting off power transmission from a driving body to a driven body when a constant torque load is applied thereto.

The present invention provides a coupling member for coupling a driven body with a driving body to transmit driving force of the driving body to the driven body and cutting off the power transmission when a load for driving the driven body exceeds a given value, the coupling member comprising: a pair of sidepiece portions disposed parallel to each other; a pair of bent portions having free ends, basic ends joined integrally to first ends of the sidepiece portions respectively and sandwich portions supporting a first pin mounted on one of the driving body and the driven body by sandwiching, wherein each sandwich portion comprising: plural projections disposed at regular intervals one another in a circumferential direction of the first pin and contacted with the outside circumferential surface of the first pin; and plural surfaces each disposed between the adjacent projections and opposed to the outside circumferential surface of the first pin at a regular distance therefrom; and a curved portion having both ends joined integrally to second ends of the sidepiece portions respectively and a hole through and into which a second pin mounted on one of the driving body and the driven body is passed and fitted, wherein the first pin is sandwiched between the sandwich portions by inserting the first pin into a spacing between the sidepiece portions and then pressing the first pin toward the bent portion side to deform the bent portions in a direction away from each other and the first pin is released from the sandwich portions in a direction of the free end side of the bent portion when the load applied to the first pin exceeds a given value.

According to the present invention, the contact area between the first pin and the coupling member is suppressed to a minimum because the projections are only contacted with the outside circumferential surface of the first pin under the condition where the sandwich portions support the first pin by sandwiching. Therefore, this prevents the force, which is required for releasing the first pin out of the coupling member, from suffering from the age-degradation of the coupling member. As a result, power transmission is always cut off at a constant torque load.

BEST MODE FOR CARRYING OUT THE INVENTION

A first to a third embodiment of the present invention will be described. Besides, an X-axis, a Y-axis and a Z-axis are set in the longitudinal direction, the lateral direction and the vertical direction of a compressor, respectively. The X-axis, the Y-axis and the Z-axis are perpendicular to one another.

First Embodiment

The first embodiment will be described referring to FIGS. 3 to 14.

Figure 1:
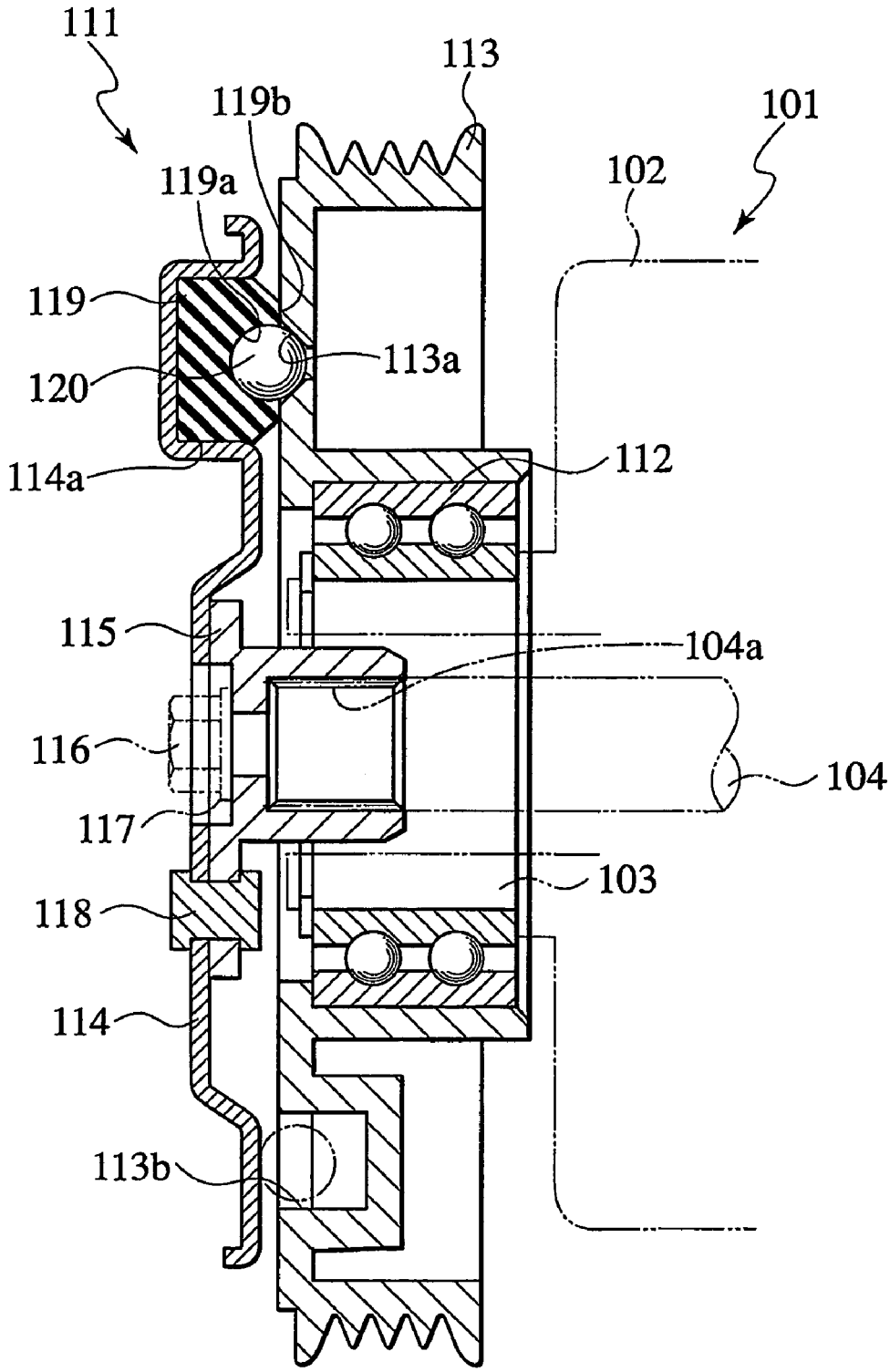
FIG. 1 PRIOR ART
FIG. 1 is a cross-sectional view of the main portion of a conventional power transmission device.
Figure 2:
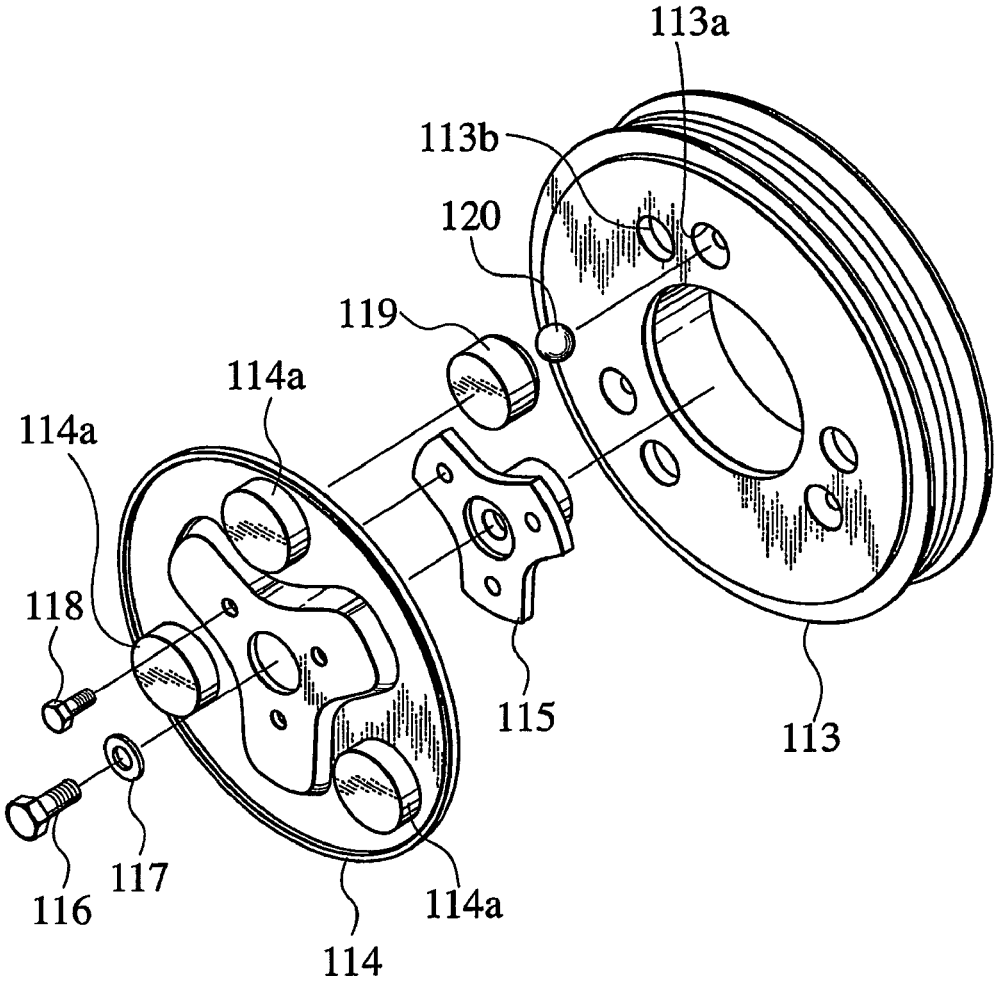
FIG.2 PRIOR ART
FIG. 2 is an exploded perspective view of the main portion of the conventional power transmission device.
Figure 3:
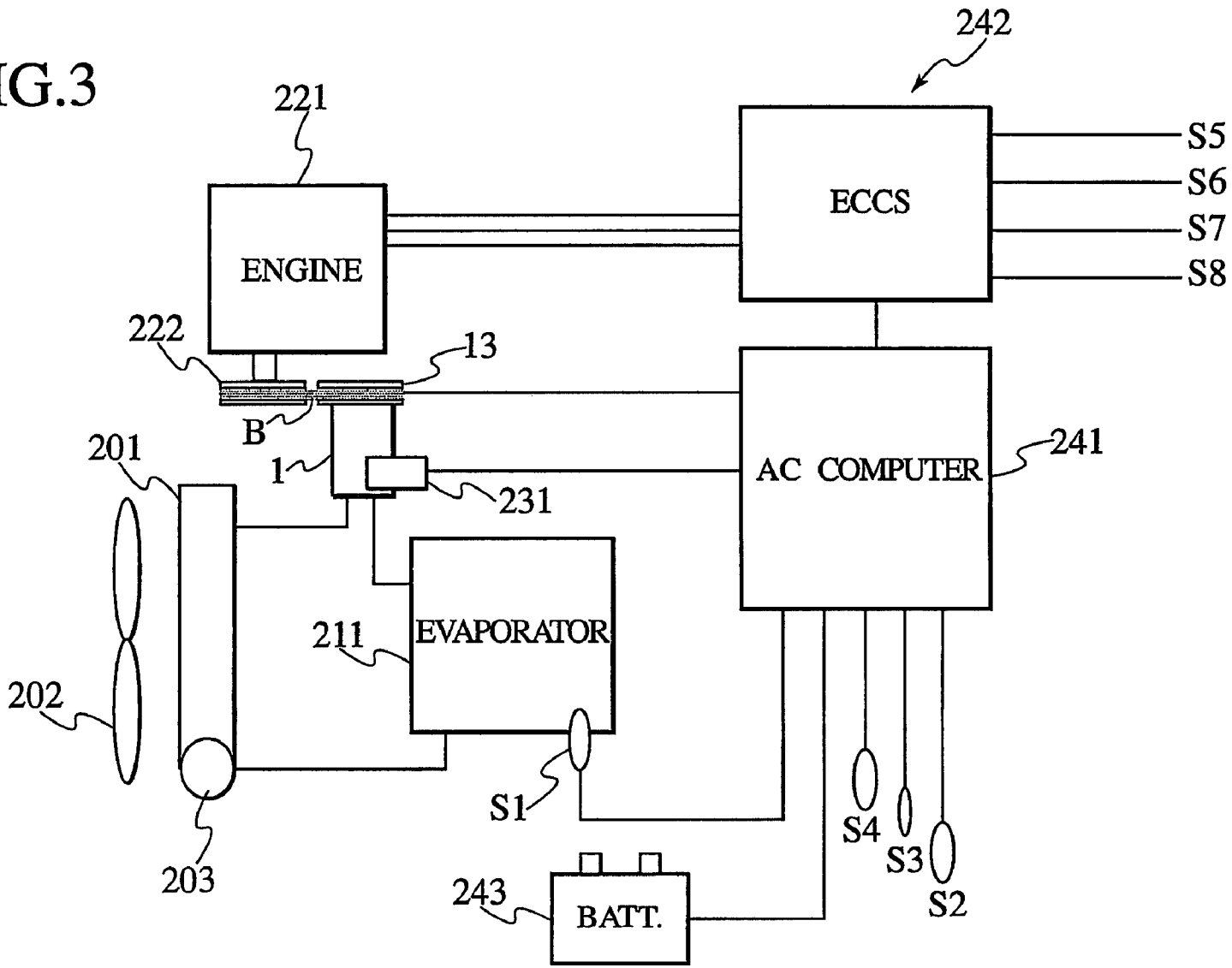
FIG. 3 is a schematic view of an air conditioning system for vehicles according to the present invention.

As shown in FIG. 3, an air conditioning system for vehicle includes a refrigeration-cycle and a controller. The refrigeration-cycle includes a clutchless compressor 1, a condenser 201 and an evaporator 211. The compressor 1 is driven by an engine 221 to compress a vaporized refrigerant.

The condenser 201 liquefies the compressed refrigerant and has a cooling fan 202 and a liquid tank 203. The evaporator 211 vaporizes the liquefied refrigerant. The vaporized refrigerant is sucked in the compressor 1 from the evaporator 211.

The controller includes an AC computer 241 and ECCS (electronic concentrated engine control system) 242. The AC computer 241 is driven by a battery 243 and obtains information from sensors S1, S2, S3 and S4. The sensor S1 detects a temperature at the outlet of the evaporator 211. The sensor S2 detects an internal temperature of the vehicle. The sensor S3 is a solar radiation sensor. The sensor S4 detects an external temperature of the vehicle. The AC computer 241 controls an electronic control valve 231 mounted to the compressor 1 on the basis of information from the sensors S1, S2, S3 and S4.

The ECCS 242 obtains information from sensors S5, S6, S7 and S8. The sensor S5 detects the speed of the vehicle. The sensor S6 detects the opening rate of an accelerator. The sensor S7 detects the rotational speed of a wheel or an axle. The sensor S8 detects a suction air pressure of the engine 221. The ECCS 242 controls the engine 221 on the basis of information from the sensor S5, S6, S7 and S8.

Figure 4:
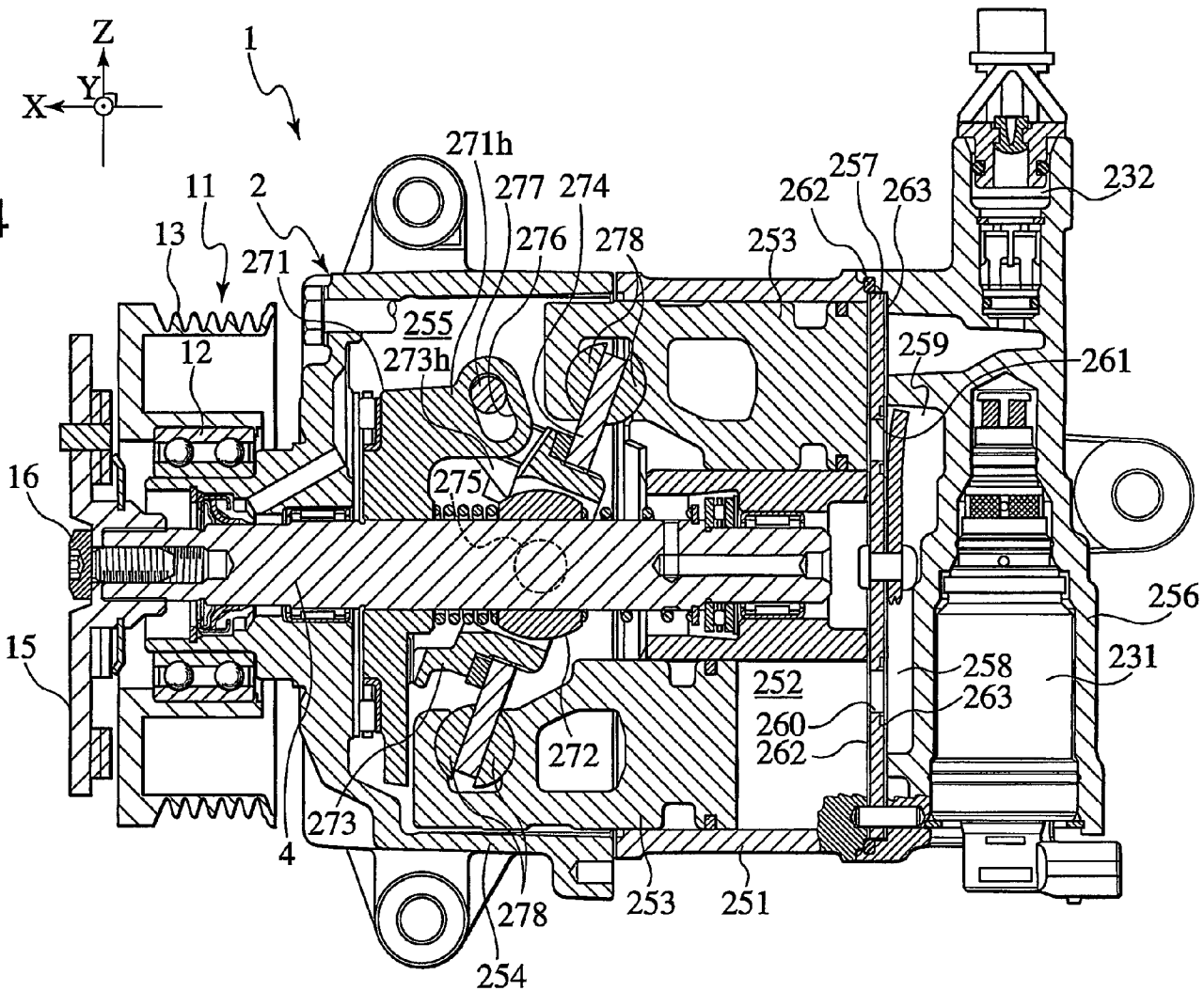
FIG. 4 is a side view of a compressor according to the present invention.

As shown in FIG. 4, the compressor 1 includes a housing 2, a rotary shaft 4 and a power transmission device 11. The housing 2 has a cylinder block 251, a front housing 254 and a rear housing 256.

The cylinder block 251 defines a plurality of cylinder bores 252. A plurality of cylinders 253 are slidably accommodated in the cylinder bores 252 in the axial direction (the X axis), respectively. The front housing 254 is connected to the +X side of the cylinder block 251 to define a crank chamber 255 adjacent to the cylinder block 251. The rear housing 256 is connected to the −X side of the cylinder block 251 via a valve plate 257 to define suction chambers 258 and discharge chambers 259. The valve plate 257 has inlets 260 communicating with the suction chambers 258 and the cylinder bores 252 and outlets 261 communicating with the discharge chambers 259 and the cylinder bores 252. The inlets 260 and the outlets 261 are covered with suction plates 262 and discharge plates 263, respectively.

The crank chamber 255 includes a drive plate 271, a sleeve 272, a journal 273 and a swash plate 274 therein. The drive plate 271 is fixedly mounted on the rotary shaft 4. The sleeve 272 is slidably fitted with the rotary shaft 4. The journal 273 is swingably connected to the sleeve 272 through a pin 275. The swash plate 274 is fixed to the end of the journal 273.

The drive plate 271 and the journal 273 have hinge arms 271*h*, 273*h*, respectively, that are connected to one another by means of an elongated slot 276 and a pin 277, thereby restricting a swing motion of the swash plate 274. The cylinders 253 are connected to the swash plate 274 through a pair of shoes 278 between which the swash plate 274 is sandwiched, resulting in reciprocating movements of the cylinders 253 on the basis of motive power caused by rotational movement of the rotary shaft 4.

Thus, the compressor 1 has a basic function in that reciprocating movements of the cylinders 253 sucks refrigerant in a path through the evaporator 211→the suction chambers 258→the inlets 260→the cylinder bores 252 and compresses sucked refrigerant whereupon compressed refrigerant is discharged in a path through the cylinder bores 252→the outlets 261→the discharge chambers 259→the condenser 201.

The rear housing 256 includes the electronic control valve 231 and a check valve 232 therein. The electronic control valve 231 feeds a part of compressed refrigerant in the discharge chamber 259 to the crank chamber 255 in order to regulate pressure in the crank chamber 255. The swash plate 274 is controlled at an inclined angle by differential pressure between the suction chambers 258 and the crank chamber 255. The angle change of the swash plate 274 changes stroke of each cylinder 253, which changes discharge volume of a refrigerant.

The rotary shaft 4 has an end portion 4*a* passing loosely through a boss portion 3, which is formed on the +X side of the front housing 254. The boss portion 3 is coaxial with the rotary shaft 4.

Figure 5:
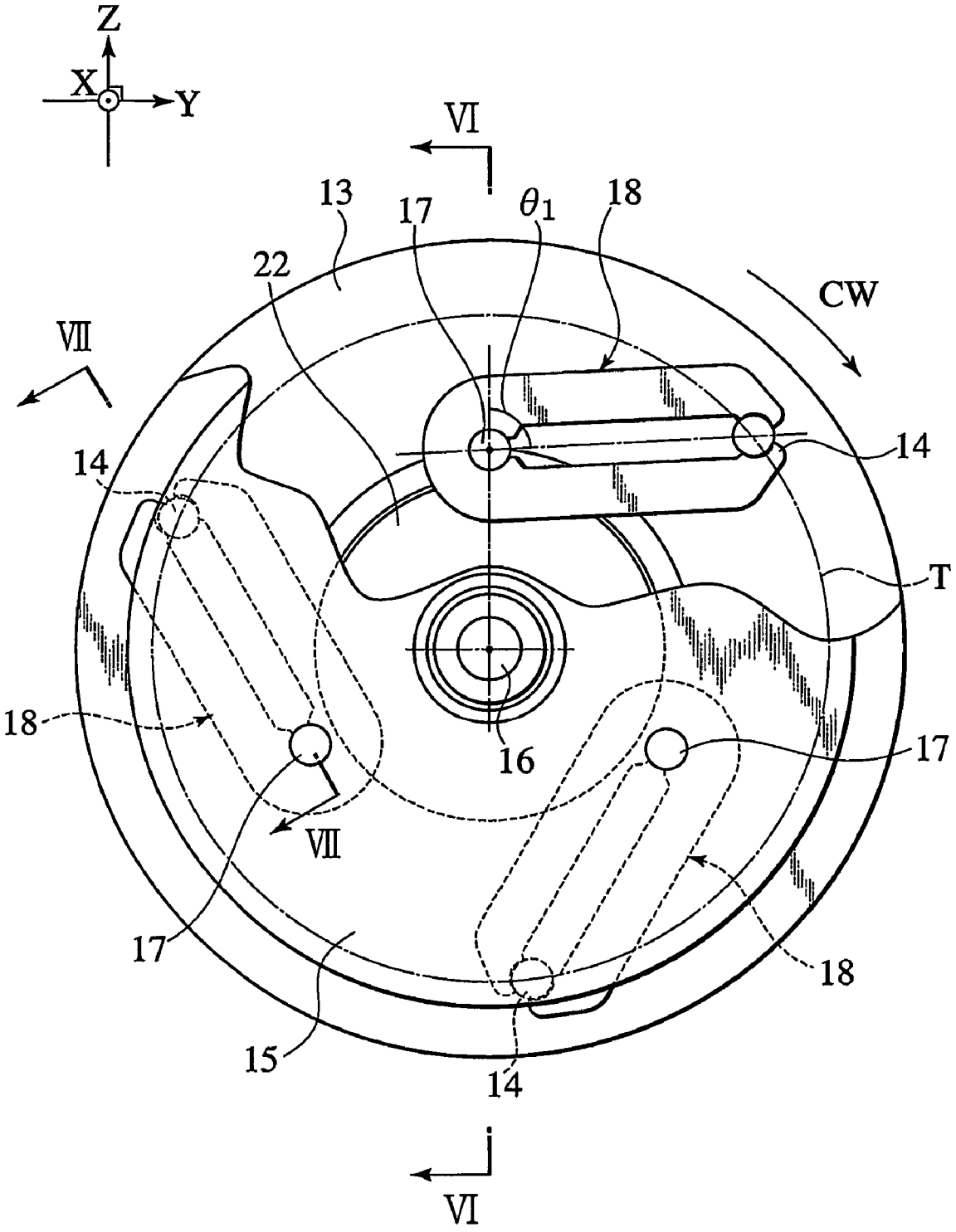
FIG. 5 is a side view of the main portion of a power transmission device relating to a first embodiment of the present invention.
Figure 6:
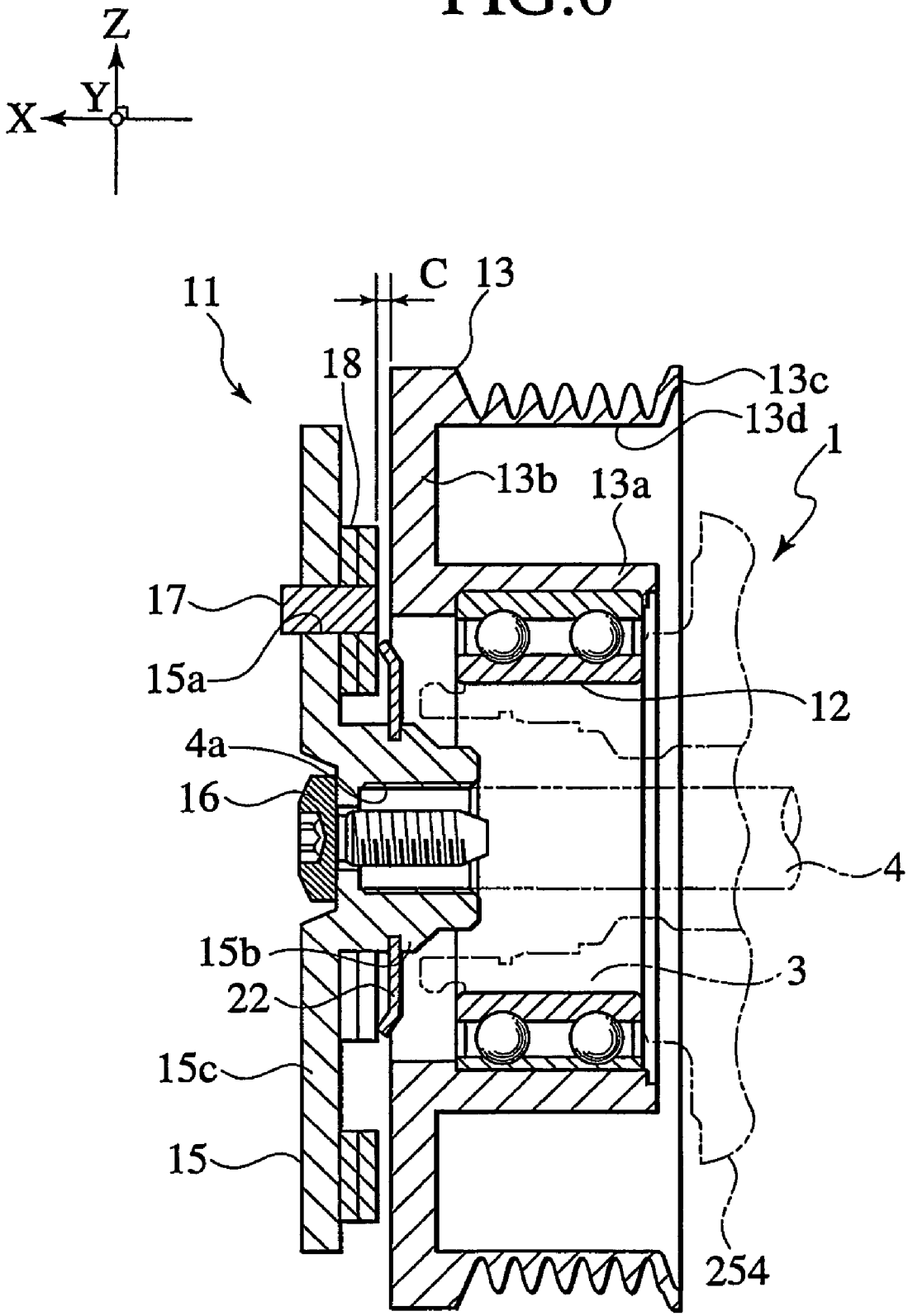
FIG. 6 is a cross-sectional view sectioned along the VI-VI line in FIG. 5.

As shown in FIGS. 5 and 6, the power transmission device 11 comprises a bearing 12, a pulley 13, plural first pins 14, a hub 15, a bolt 16, plural second pins 17, plural coupling members 18 and a linking mean 22.

The pulley 13 is rotatably attached to the boss portion 3 via the bearing 12. The pulley 13 has an inner cylinder portion 13*a*, a joint portion 13*b* and an outer cylinder portion 13*c*. The inner cylinder portion 13*a* is formed in the shape of a cylinder and is coaxial with the rotary shaft 4. The joint portion 13*b* is formed, in the shape of a round ring, integrally on the outside surface of a first end (+X side) of the inner cylinder portion 13*a* and protrudes outward in the radial direction of the inner cylinder portion 13*a*. The outer cylinder portion 13*c* is formed, in the shape of a cylinder, integrally at the circumferential end of the joint portion 13*b* and is coaxial with the rotary shaft 4. The outer cylinder portion 13*c* has an outside surface on which a plurality of V grooves are formed for winding the belt B on them. The belt B is coupled with a pulley 222 of the engine 221 (refer to FIG. 3). The pulley 13 has an annular recess 13*d* formed by the outside surface of the inner cylinder portion 13*a*, the end surface on the −X side of the joint portion 13*b* and the inside surface of the outer cylinder portion 13*c*. The recess 13*d* is open in the −X direction.

Figure 7:
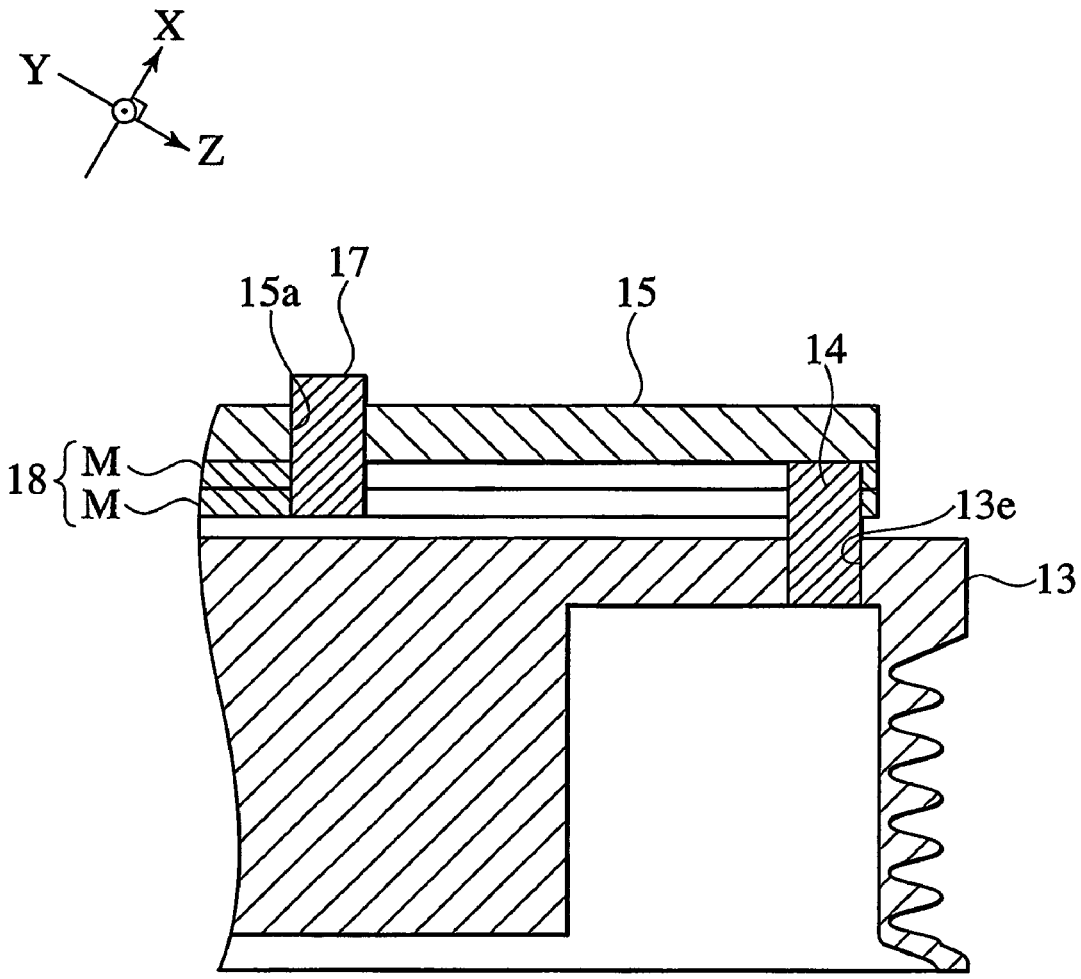
FIG. 7 is a cross-sectional view sectioned along the VII-VII line in FIG. 5.

As shown in FIGS. 5 and 7, the joint portion 13*b* of the pulley 13 has a periphery on which a plurality of pin-insertion holes 13*e* are formed. The pin-insertion holes 13*e* are disposed along the same circumference whose center coincides with the axis of the joint portion 13*b*. Each of the pin-insertion holes 13*e* is located a regular angle apart from the adjacent ones 13*e*. In the case of the present embodiment, three pin-insertion holes 13*e* are located 120° apart from one another on the periphery of the joint portion 13*b*.

The first pins 14 are formed in the shape of a cylinder. Each of the first pins 14 is passed through and fitted into one of the pin-insertion holes 13*e* formed on the periphery of the joint portion 13*b*, and is arranged on the +X side periphery of the joint portion 13*b* in a standing condition.

The hub 15 is fixed to the end portion 4*a* of the rotary shaft 4 with the bolt 16. The hub 15 is coaxial with the rotary shaft 4. Further, the hub 15 has a periphery on which a plurality of pin-insertion holes 15*a* are formed. The pin-insertion holes 15*a* are disposed along the same circumference whose center coincides with the axis of the hub 15. Each of the pin-insertion holes 15*a* is located a regular angle apart from the adjacent ones 15*a*. In the case of the present embodiment, three pin-insertion holes 15*a* are located 120° apart from one another on the periphery of the hub 15.

The second pins 17 are formed in the shape of a cylinder. Each of the second pins 17 is passed through and fitted into one of the pin-insertion holes 15*a*. The second pin 17 is coupled with the first pin 14 via the coupling member 18. In the case of the present embodiment, a power-transmission cutoff member is composed of the first pins 14, the second pins 17 and the coupling members 18.

The coupling member 18 is made of spring material such as high carbon steel, and is of a forked leaf spring which is substantially U-shaped. In particular, as shown in FIG. 7, the coupling members 18 are manufactured by stacking a plurality of sheets punched out of plate material M such as high carbon steel into the shape of the letter U. Additionally, the coupling member 18 may be made of a monolithic sheet of the plate material M. In the case of the present embodiment, two sheets of the plate material M are stacked. By employing the above manufacturing method, not only productivity is enhanced but also burrs, deformations, etc. are hardly yielded because punching can be easily performed. Therefore, spring load of the coupling members 18 becomes stable.

Figure 8:
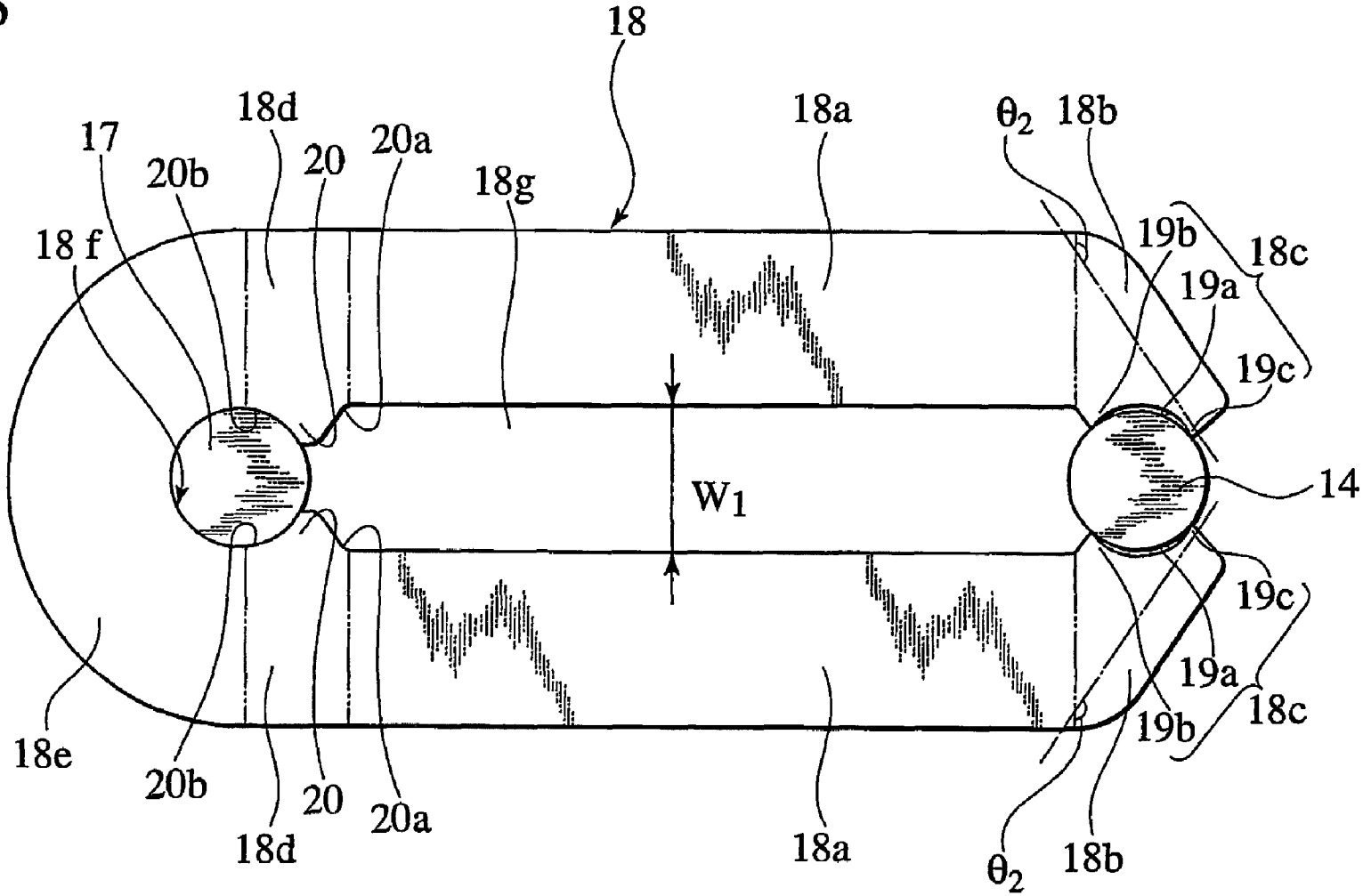
FIG. 8 is a plan view of a coupling member relating to the first embodiment of the present invention.

As shown in FIG. 5, the coupling members 18 are arranged between the pulley 13 and the hub 15 so as to cross at an acute angle ($\theta 1<90°$) to the radial direction of the pulley 13 and the hub 15. As shown in FIG. 8, the coupling member 18 has a pair of sidepiece portions 18*a*, a pair of bent portions 18*b*, a pair of sandwich portions 18*c*, a pair of joining portions 18*d*, a curved portion 18*e*, a through-hole

18*f* and a spacing 18*g*. The first pin 14 inserted into the pin-insertion hole 13*e* is sandwiched between the sandwich portions 18*c*, 18*c*. The second pin 17 inserted into the pin-insertion hole 15*a* is fitted into the through-hole 18*f*. The sidepiece portions 18*a*, 18*a* are formed in the shape of a rectangle and are disposed parallel to each other.

Figure 9:
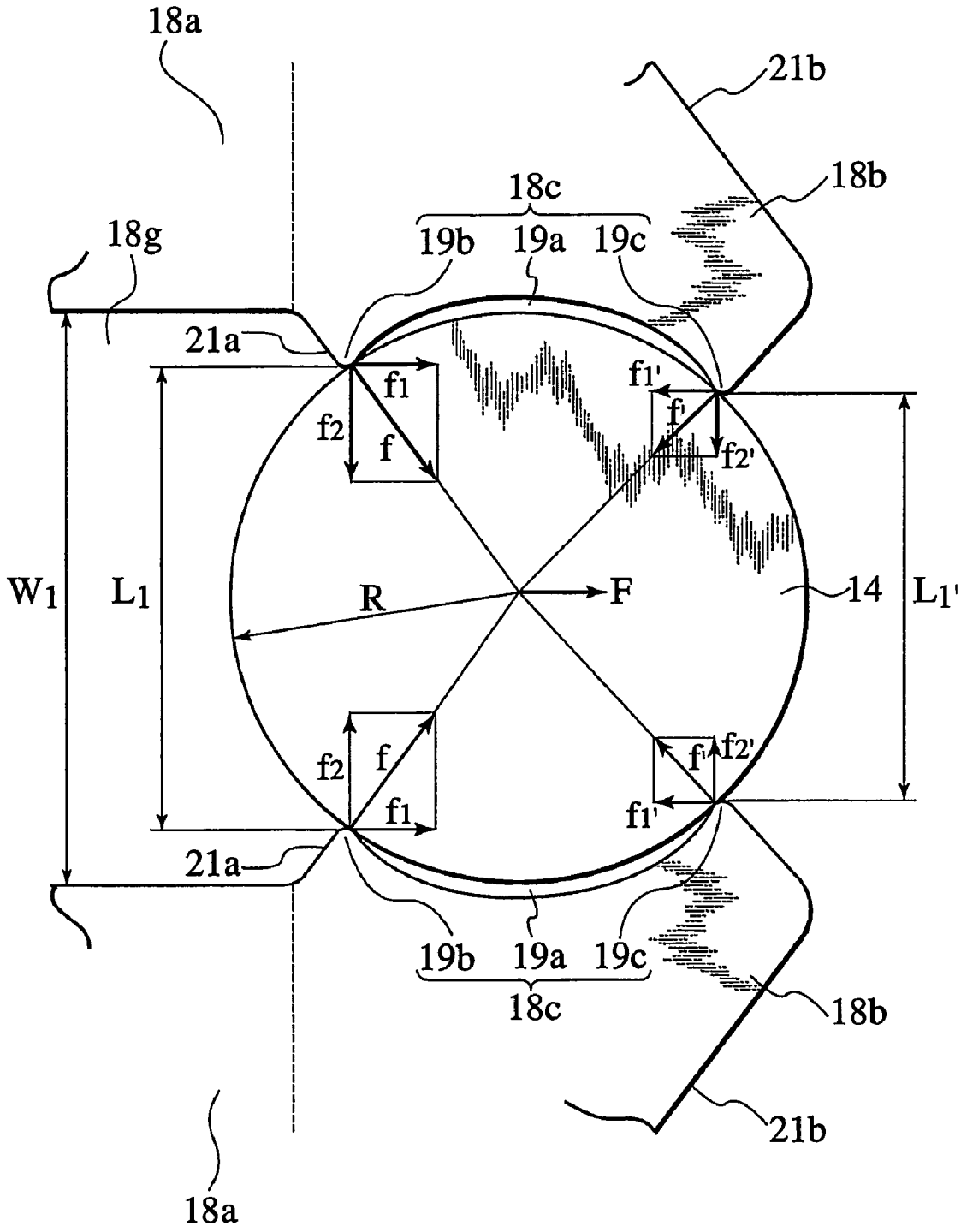
FIG. 9 is an enlarged plan view of the main portion of FIG. 8.

The bent portions 18*b*, 18*b* are bent at a given angle θ2 to the sidepiece portions 18*a*, 18*a*, and are configured to extend from first ends of the sidepiece portions 18*a*, 18*a* respectively, so as to come close to each other. As shown in FIG. 9, the bent portions 18*b*, 18*b* have inside surfaces 19*a*, 19*a*, first projections 19*b*, 19*b* and second projections 19*c*, 19*c*, respectively. Curvature of each inside surface 19*a* is larger than that of the first pin 14. It should be noted that the curvature of each inside surface 19*a* may be equal to or less than that of the first pin 14 if the inside surface 19*a* does not contact with the outside circumferential surface of the first pin 14. The first projection 19*b* and the second projection 19*c* are provided at both end portions of the inside surface 19*a*, and are formed in the round shape. The inside surface 19*a* is formed on the bent portion 18*b* in the press working with diameter which is smaller than that of the first pin 14. An inside surface 21*a* and an outside surface 21*b* of the bent portion 18*b* is substantially parallel to each other.

With regard to a pair of the bent portions 18*b*, the first projection 19*b* and the second projection 19*c* of one bent portion 18*b* are respectively opposite to the first projection 19*b* and the second projection 19*c* of the other bent portion 18*b* at a given distance from each other. A distance L1 between the first projections 19*b*, 19*b* is larger than a distance L1' between the second projections 19*c*, 19*c*. Further, the distance L1 is of the length between the first projections 19*b*, 19*b* to support one side of the first pin 14 by sandwiching in stress less than elastic limit of the bent portions 18*b*, 18*b*. Further, the coupling member 18 holds the first pin 14 via the sandwiching portions 18*c*, 18*c* by acting an adequate elastic force thereof.

The sandwich portions 18*c*, 18*c* are formed by the inside surfaces 19*a*, 19*a*, the first projections 19*b*, 19*b* and the second projections 19*c*, 19*c* provided in the bent portions 18*b*, 18*b*. In a state where the sandwich portions 18*c*, 18*c* support the first pin 14 by sandwiching, the first projections 19*b*, 19*b* and the second projections 19*c*, 19*c* are point-contacted with the outside circumferential surface of the first pin 14 in the plan view of the coupling member 18, and line-contacted with the outside circumferential surface of the first pin 14 in the cross-sectional view of the coupling member 18. Also, the outside circumferential surface of the first pin 14 is opposite to the inside surfaces 19*a*, 19*a* at a given distance from the inside surfaces 19*a*, 19*a*.

The joining portions 18*d*, 18*d* are configured to extend from second ends of the sidepiece portions 18*a*, 18*a*, and arranged to be parallel to each other. The curved portion 18*e* is formed in the shape of a semicircular ring. The second end of one sidepiece portion 18*a* is joined integrally to the first end of the curved portion 18*e* via one joining portion 18*d*. And, the second end of the other sidepiece portion 18*a* is joined integrally to the second end of the curved portion 18*e* via the other joining portion 18*d*.

Protrusions 20, 20 are formed on the inside surfaces of the joining portions 18*d*, 18*d*, respectively. One protrusion 20 is opposite to the other protrusion 20 at a given distance from the other protrusion 20. A first slant 20*a* of the protrusion 20 positioned on the sidepiece 18*a* side is convex outward, and a second slant 20*b* of the protrusion 20 positioned on the curved portion 18*e* side are concave inward. Each of the second slants 20*b*, 20*b* is smoothly joined to the inside surface of the curved portion 18*e*. In the plan view of the coupling member 18, both the second slants 20*b*, 20*b* and the inside surface of the curved portion 18*e* are located on the same circumference.

The through-hole 18*f* is formed by the second slants 20*b*, 20*b* of the joining portions 18*d*, 18*d* and the inside surface of the curved portion 18*e*. The second pin 17 is passed through and fitted into the through-hole 18*f*.

The spacing 18*g* is formed between the sidepiece portions 18*a*, 18*a*, and between the first slants 20*a*, 20*a* of the protrusions 20, 20 of the joining portions 18*d*, 18*d*. The width W1 of the spacing 18*g* is larger than the distances L1, L1' and slightly larger than a diameter of the first pin 14. Hollow portions of the sandwich portions 18*c*, 18*c* and the through-hole 18*f* are communicated with the spacing 18*g*.

The linking means 22 presses the coupling member 18 against the hub 15. As shown in FIG. 6, the linking means 22 is of a washer-like resilient member concentrically mounted on the outside circumferential surface of an axial portion 15*b* of the hub 15. The linking means 22 has an end portion bent toward a flange portion 15*c* of the hub 15. The coupling member 18 is slidably pressed against the rear surface of the flange portion 15*c* of the hub 15 by means of the linking mans 22 and is linked to the hub 15.

A given gap (width C) as a clearance should be provided between the pulley 13 and the coupling member 18. Since the linking means 22 presses the coupling member 18 against the hub 15, the clearance larger than the given gap can be easily secured.

Figure 10:
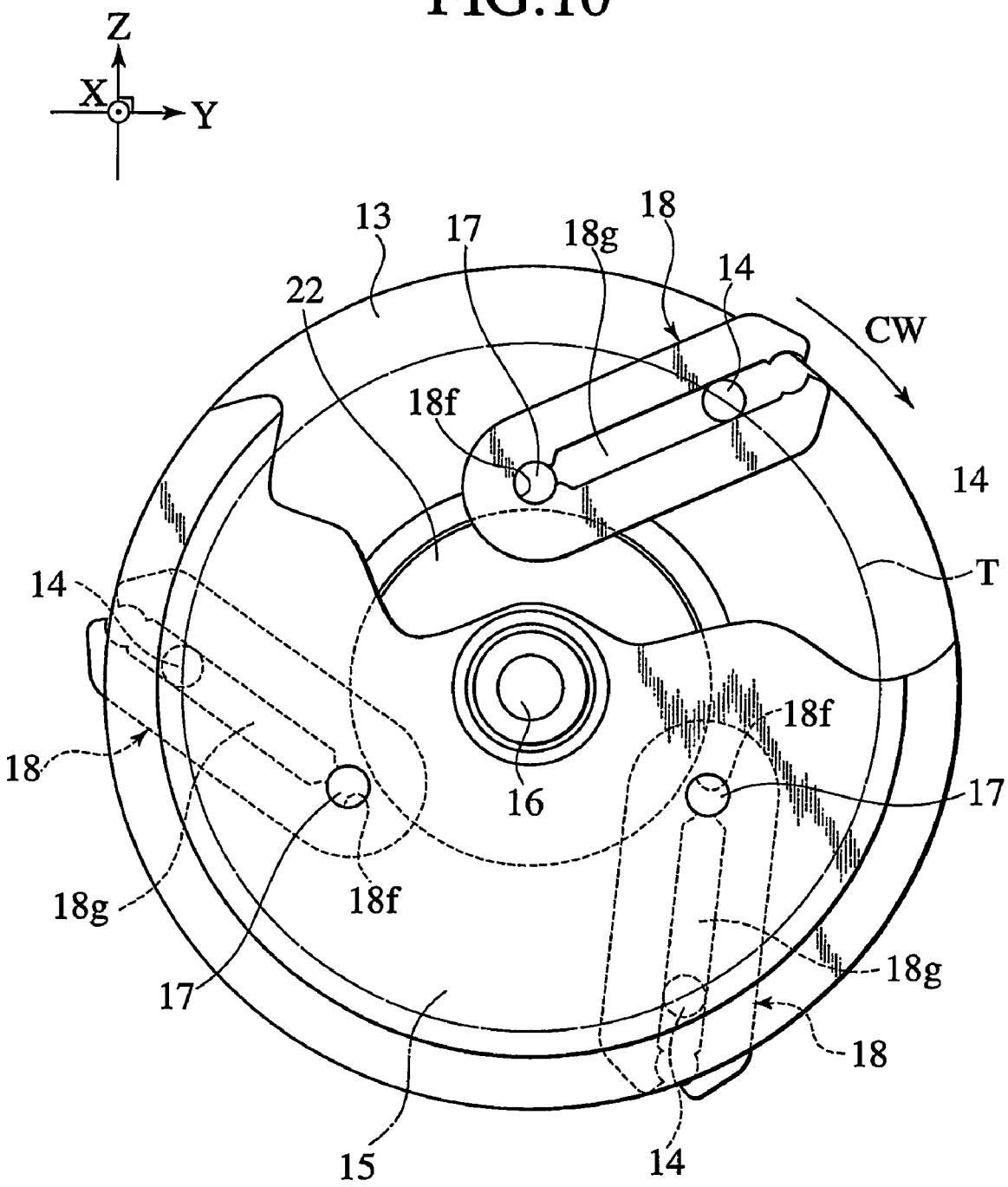
FIG. 10 is an explanatory view showing an assembling method of the power transmission device relating to the first embodiment of the present invention.

In the following, a method of coupling the first pin 14 and the second pin 17 on the coupling member 18 will be described referring to FIGS. 5 and 10.

First, each second pin 17 is inserted into each of the pin-insertion holes 15*a* of the hub 15. Second, after inserting each end portion of the second pin 17 into each of the through-holes 18*f* of the coupling members 18, the linking means 22 is fitted on the axial portion 15*b* of the hub 15. Then, by means of fastening the linking means 22 in a groove provided around on an outside circumferential surface of the axial portion 15*b*, the coupling member 18 is linked with the hub 15.

Next, each first pin 14 is inserted into each of the pin-insertion holes 13*e* of the pulley 13 to make an end portion of the first pin 14 protrude from the front surface of the joint portion 13*b* of the pulley 13. Then, after inserting each end portion of the first pin 14 into each spacing 18*g* of the coupling members 18, the hub 15 is fixed to the end portion 4*a* of the rotary shaft 4 with the bolt 16 (refer to FIG. 10).

Next, while fastening the hub 15 so as not to be rotated, the first pin 14 moves toward an open end (the sandwich portions 18*c*, 18*c*) side of the spacing 18*g* by rotating the pulley 13 in the direction of an arrow CW (clockwise when viewing in the direction of +X). As the pulley 13 is rotated further in the direction of the arrow CW, the first pin 14 presses the first projections 19*b*, 19*b* via outside surface thereof to make the whole coupling member 18 deform elastically and to gradually broaden the distance L1 between the sandwich portions 18*c*, 18*c*. Consequently, the first pin 14 is entered between the sandwich portions 18*c*, 18*c* and then the outside surface of the first pin 14 is opposite to the inside surfaces 19*a*, 19*a* of the sandwich portions 18*c*, 18*c*. When the pulley 13 is stopped in the preceding situation, the first projections 19*b*, 19*b* and the second projections 19*c*, 19*c* are pressed against the outside surface of the first pin 14, thereby the first pin 14 is sandwiched between the sandwich portions 18*c*, 18*c* (refer to FIG. 5).

The first pin 14 is received in the spacing 18*g* and free to move in the width direction of the spacing 18*g* because the width W1 of the spacing 18*g* of the coupling member 18 is slightly larger than the diameter of the first pin 14. Therefore, the first pin 14 moves smoothly toward the sandwich portions 18*c*, 18*c* as the pulley 13 rotates.

In the following, functions of the power transmission device 11 and the coupling member 18 will be described referring to FIGS. 11A to 11E.

When a torque load on the coupling member 18 is smaller than a given value, power of the engine is transmitted via the belt sequentially to, the pulley 13, the first pins 14, the coupling members 18, the second pins 17 and the hub 15, and the power makes the rotary shaft 4 rotate.

Figure 11A:
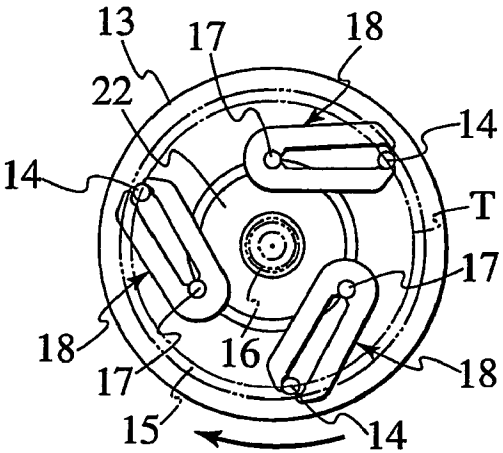
FIGS. 11A to 11E are explanatory views showing a power cutoff mechanism in the power transmission device relating to the first embodiment of the present invention.
Figure 11B:
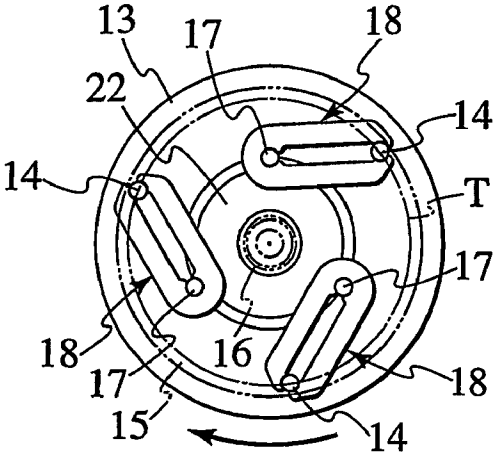

When a torque overload is generated in the compressor 1, a torque load is applied onto the coupling member 18 (refer to FIG. 11A). If the torque load exceeds the given value, the first pin 14 deforms the coupling member 18 via the second projections 19*c*, 19*c* as the pulley 13 rotates, and then the first pin 14 is released from the coupling member 18 (refer to FIG. 11B). At this time, the coupling member 18 crosses at about right angle ($\theta 1 \approx 90°$) to the radial direction of the pulley 13 and the hub 15. Through the above mechanism, the power transmission from the pulley 13 to the rotary shaft 4 is cut off, and the pulley 13 will run idle.

Figure 11C:
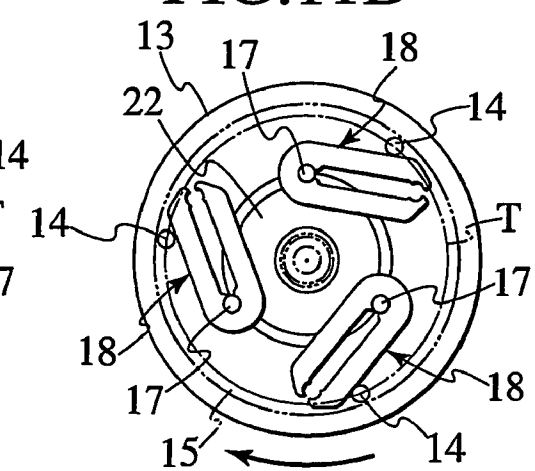
Figure 11D:
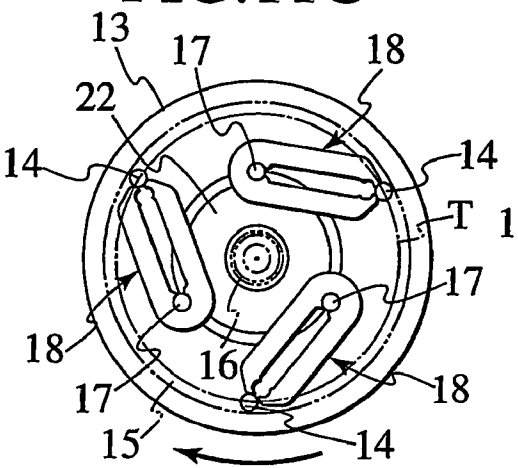
Figure 11E:
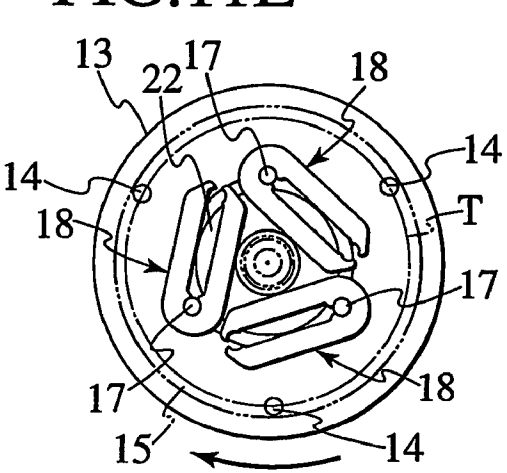

After the first pin 14 has been released from the coupling member 18, the coupling member 18 stays on the movement locus T of the first pin 14 (refer to FIG. 11C). However, the coupling member 18 pivots inward from the movement locus T around the second pin 17 as sliding on the linking means 22, due to collision between the coupling member 18 and the first pin 14 revolving along the movement locus T as the pulley 13 rotates (refer to FIGS. 11D and 11E). Consequently, the coupling member 18 is linked in the region where preventing the coupling member 18 from interfering with the movement of the first pin 14. Therefore, even though the pulley 13 continues to rotate, the first pin 14 does not collide again with the coupling member 18 after the first pin 14 has collided only once with the coupling member 18 and so generation of noises can be prevented.

In the following, in order to explain time-change of reaction force acting from the coupling member 18 to the first pin 14 in the above release process, described will be the case where force F acts axially on the coupling member 18 in a state where the first pin 14 is sandwiched between the sandwich portions 18*c*, 18*c*.

As shown in FIG. 9, through sandwiching the first pin 14 between the sandwich portions 18*c*, 18*c*, reaction forces f, f' from the first projection 19*b* and the second projection 19*c* act on the outside surface of the first pin 14. Further, the reaction forces f, f' act along the lines joining the center of the first pin 14 and the first projection 19*b*, the second projection 19*c*, respectively. In the case where force F acting on the open end side of the coupling member 18 (in the horizontal direction) does not act on the first pin 14, a horizontal component f1 of the reaction force f is equal to a horizontal component f1' of the reaction force f', but acts in the opposite direction of the component f1'. At this time, vertical components f2, f2' of the reaction forces f, f' on one hand are equal to vertical components f2, f2' of the reaction forces f, f' on the other hand, but acts in the opposite direction of the vertical components f2, f2' on the other hand.

Once the force F acts on the first pin 14, the first pin 14 is pressed against the second projections 19*c*, 19*c*, and as a result the horizontal component f1 will become smaller and the horizontal component f1' will become larger at the same time. When the first pin 14 is pressed against the second projections 19*c*, 19*c* in a state where the first pin 14 contacts to the first projections 19*b*, 19*b*, the following relationship holds: F+2f1=2f1'. When the first pin 14 is pressed against the second projections 19*c*, 19*c* in a state where the first pin 14 is apart from the first projections 19*b*, 19*b*, the following relationship holds: f1=0, F=2f1'.

When the force F exceeds the given value, the first pin 14 deforms the coupling member 18 to broaden the distance L1' between the sandwich portions 18*c*, 18*c* through pressing the second projections 19*c*, 19*c* by means of the outside surface thereof. Further, when the force F increases, the first pin 14 is released from the sandwich portions 18*c*, 18*c* after the distance L1' is equal to the diameter of the first pin 14.

In the above release process, force (pull-out load) acting from the first pin 14 to the coupling member 18 is maximized when the coupling member 18 crosses at a right angle ($\theta 1=90°$) to the radial direction of the pulley 13 and the hub 15.

When the engine 221 stops, the pulley 13 stops rotating but the hub 15 momently rotates by inertia force. At this time, the first pin 14 slightly moves toward a basic end (the spacing 18*g*) side of the sandwich portions 18*c*, 18*c* and then applies load to the first projections 19*c*, 19*c*. The first projections 19*c*, 19*c* are designed so as to bear the applied load.

The power transmission device 11 has the following features.

Since the coupling member 18 is made of a spring material, it is hardly subjected to aging.

Since the curvature of each inside surface 19*a* is larger than that of the first pin 14, the first projections 19*b*, 19*b* and the second projections 19*c*, 19*c* are press-contacted with the outside circumferential surface of the first pin 14, in a state where the first pin 14 is sandwiched between the sandwich portions 18*c*, 18*c*. Therefore, contact area between the first pin 14 and the coupling member 18 is suppressed to a minimum. As a result, the coupling member 18 can support the first pin 14 by sandwiching without being rickety, which suppresses displacement of sandwiching position to a minimum. Also, generation of noise and wear can be suppressed to a minimum.

When the number of revolutions of the hub 15 is smaller than that of the pulley 13 and a torque load exceeding a given value is applied to the coupling member 18, the first pin 14 will be released from the coupling member 18. Further, since the contact area between the first pin 14 and the coupling member 18 in the present embodiment is smaller than a contact area between a rolling ball and a buffer rubber in a conventional power-transmission cutoff member, preventing the force (pull-out load), which is required for releasing the first pin 14 out of the coupling member 18, from suffering from the age-degradation of the coupling member 18. Therefore, power transmission is always cut off at a constant torque load.

Since each of the coupling members 18 is arranged at a regular angle apart from the adjacent ones 18, torque loads applied on the coupling members 18 are equal to one another. Therefore, power transmission is always cut off at a constant torque load.

When the first pin 14 is released from the coupling member 18, the coupling member 18 substantially crosses at a right angle to the radial direction of the pulley 13 and the hub 15. Therefore, arrangement space of the coupling member 18 can be reduced in size.

The difference in the distance L1 between the first projections 19*b*, 19*b* and the diameter of the first pin 14 is smaller than the difference in the distance L1' between the second projections 19*c*, 19*c* and the diameter of the first pin 14. Therefore, for the first pin 14, it is easy to entry between the sandwich portions 18*c*, 18*c* from the spacing 18*g* and difficult to go out of the sandwich portions 18*c*, 18*c* to the exterior of the coupling member 18, consequently the assembling operation can be performed easier than the conventional assembling operation, and force for sandwiching the first pin 14 is easily ensured.

Since assembling operation of the power-transmission cutoff member is completed only by fitting the first pin 14 and the second pin 17 into the sandwich portions 18*c*, 18*c* and through-hole 18*f*, respectively, the assembling operation can be performed easier than the conventional assembling operation. Consequently, enhancement of productivity is realized.

Since the spacing 18*g* communicates with the hollow portion of the sandwich portions 18*c*, 18*c*, the first pin 14 enters between the sandwich portions 18*c*, 18*c* while deforming the coupling member 18. Therefore, no auxiliary members for assembling the power-transmission cutoff member are required, and consequently miniaturization of the device is realized.

Once the rotary shaft 4 stops rotating due to occurrence of burn-in, etc. in the interior of the compressor 1, the power transmission is cut off through releasing the first pin 14 from the coupling member 18. Therefore, since the coupling member 18 does not rotate, the operator is protected from being injured through collision with the coupling member 18 and so forth.

In the following, a first to a fourth modification of the present embodiment will be described.

(First Modification)

Figure 12:
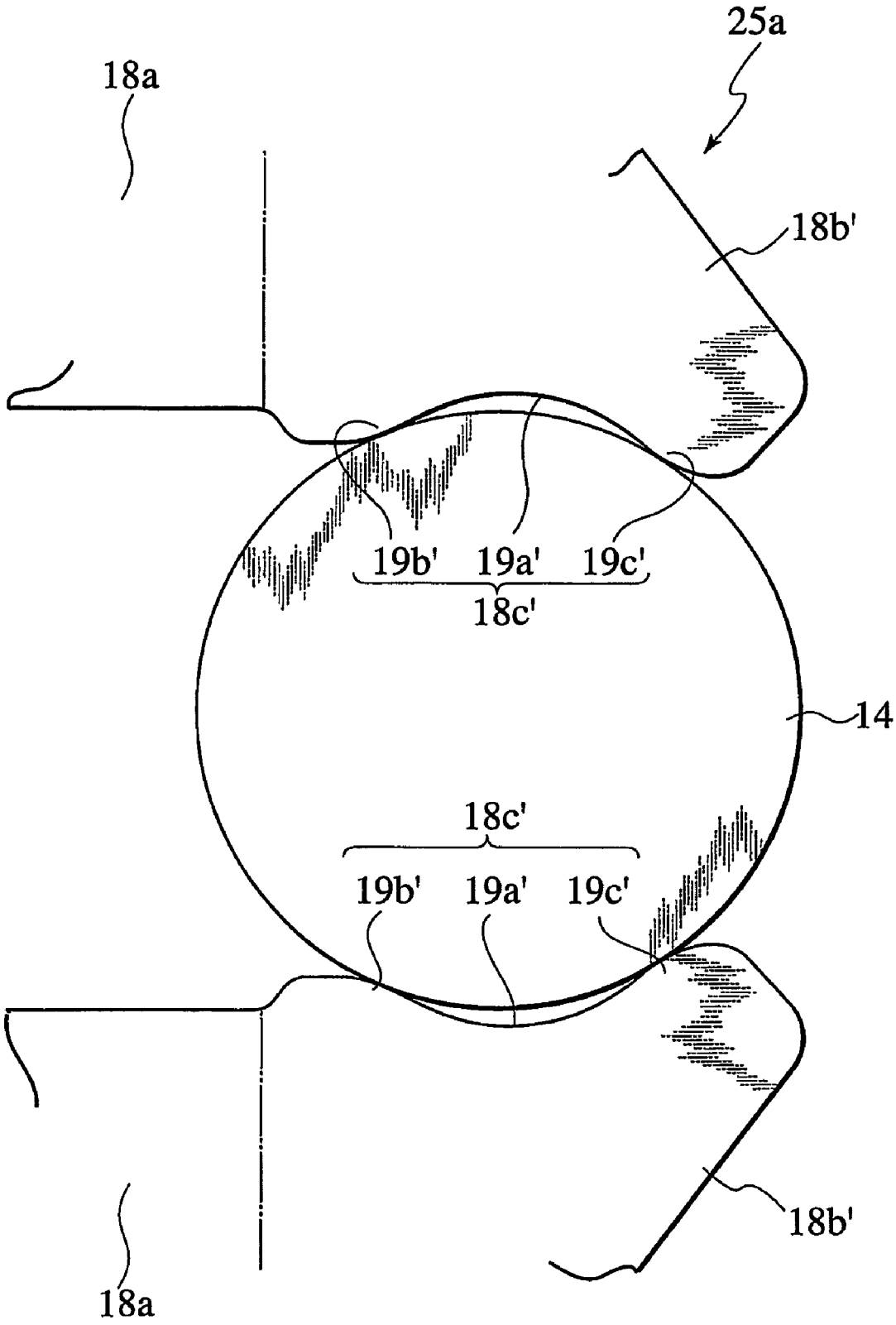
FIG. 12 is an enlarged plan view of the main portion of a coupling member relating to a first modification of the first embodiment of the present invention.

As shown in FIG. 12, sandwich portions 18*c*',18*c*' of a coupling member 25*a* is formed by inside surfaces 19*a*', 19*a*', first projections 19*b*', 19*b*' and second projections 19*c*', 19*c*'. Curvature of each inside surface 19*a*' is larger than that of the first pin 14. The first projection 19*b*' and the second projection 19*c*' are provided at both end portions of each inside surface 19*a*'. Curvatures of the first projection 19*b*' and the second projection 19*c*' are smaller than those of the first projection 19*b* and the second projection 19*c*. According to the above constitution, since contact area between the first pin 14 and the coupling member 25*a* is slightly larger than that between the first pin 14 and the coupling member 18, the first pin 14 can be securely sandwiched by the sandwich portions 18*c*, 18*c*.

(Second Modification)

Figure 13:
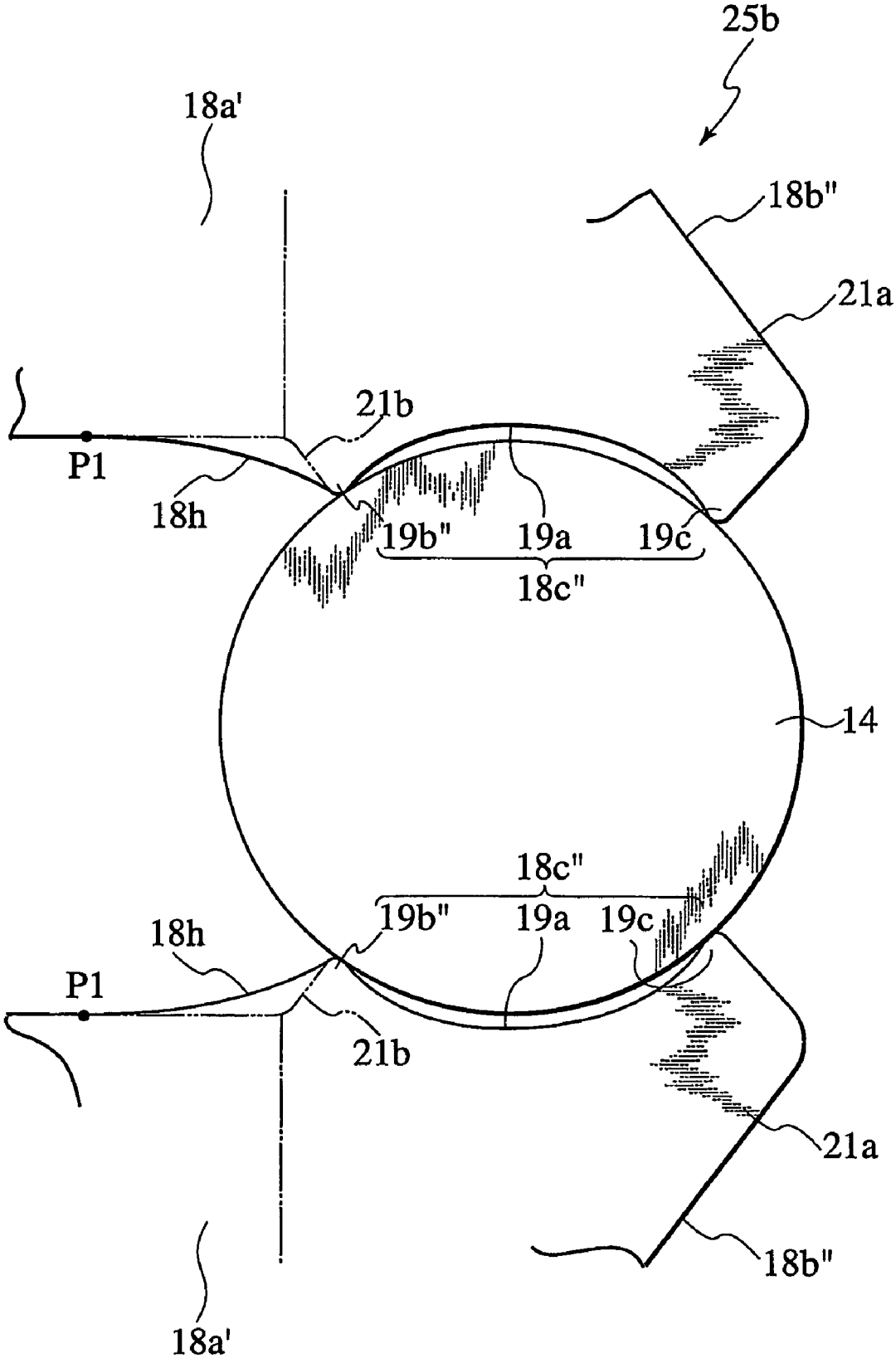
FIG. 13 is an enlarged plan view of the main portion of a coupling member relating to a second modification of the first embodiment of the present invention.

As shown in FIG. 13, in a sidepiece portion 18*a*' and a bent portion 18*b*" of a coupling member 25*b*, a first projection 19*b*" is smoothly joined to the inside surface of the sidepiece portion 18*a*'. Concretely, a slope 18*h* is formed gently from the given position P1 on the open end side of the inside surface of the sidepiece portion 18*a*' to the top of the first projection 19*b*". According to the above constitution, when the first pin 14 is coupled to the coupling member 25*b*, the first pin 14 is inserted between sandwich portions 18*c*", 18*c*" under the guidance of the slopes 18*h*, 18*h* as the pulley 13 rotates. Therefore, operation of coupling the first pin 14 to the coupling member 25*b* can be simply performed.

(Third Modification)

Figure 14:
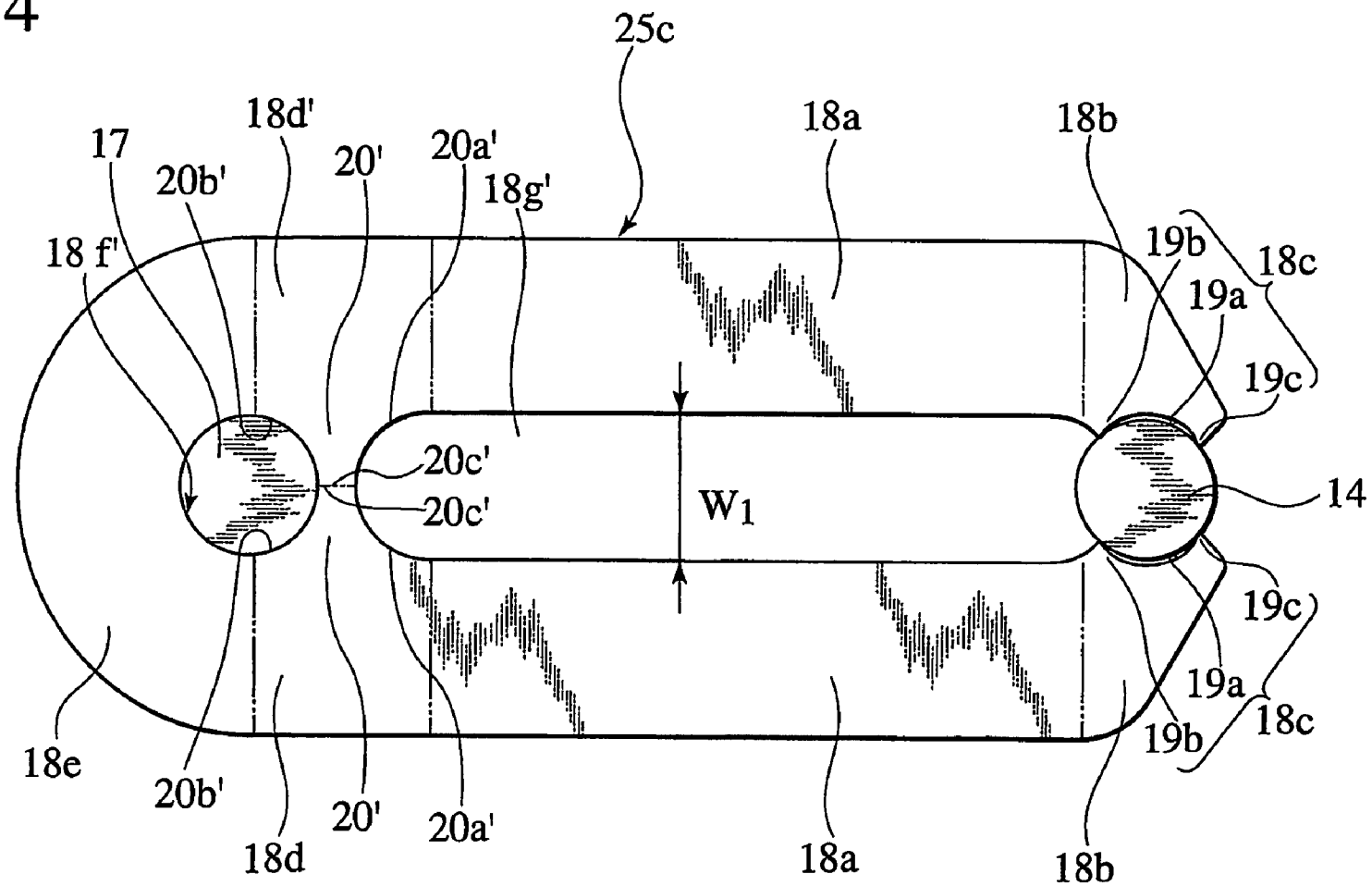
FIG. 14 is a plan view of a coupling member relating to a third modification of the first embodiment of the present invention.

As shown in FIG. 14, a through-hole 18*f* is disposed separately from a spacing 18*g*' by joining together protrusions 20', 20' of joining portions 18*d*', 18*d*' of a coupling member 25*c*. Each protrusion 20' has a first slant 20*a*', a second slant 20*b*' and a flat surface 20*c*'.

The first slants 20*a*', 20*a*' are joined to each other and also joined to inside surfaces of sidepiece portions 18*a*, 18*a*, respectively. The first slants 20*a*', 20*a*' form a semicircle with a diameter W1. The second slants 20*b*', 20*b*' are joined to each other and also joined to an inside surface of a curved portion 18*e*. In the plan view of the coupling member 25*c*, the through-hole portion 18*f* is formed by the second slants 20"*b*, 20"*b* and the inside surface of the curved portion 18*e* to be isolated from the spacing 18*g*'. The flat surfaces 20*c*', 20*c*' are disposed parallel to the axial direction of the coupling member 25*c* and are joined together. Each flat surface 20*c*' connects the first slant 20*a*' to the second slant 20*b*'. According to the above constitution, releasing of the second pin 17 from coupling member 25*c* can be securely avoided.

(Fourth Modification)

With regard to a spacing 18*g* of the coupling member 18, the width W1 of the spacing 18*g* is larger than the distance L1, L1' and also larger than the diameter of the first pin 14. According to the above constitution, the first pin 14 can be easily inserted into the spacing 18*g* when the first pin 14 is coupled with the coupling member 18. Therefore, operation of coupling the first pin 14 to the coupling member 18 can be simply performed.

Other than the above modifications, various modifications can be carried out without departing from the essential characteristics of the present invention.

For example, the first pin 14 sandwiched between the sandwich portions 18*c*, 18*c* may be disposed in the hub 15, and the second pin 17 passed through and fitted into the through-hole 18*f* may be disposed in the pulley 13.

Figure 25:
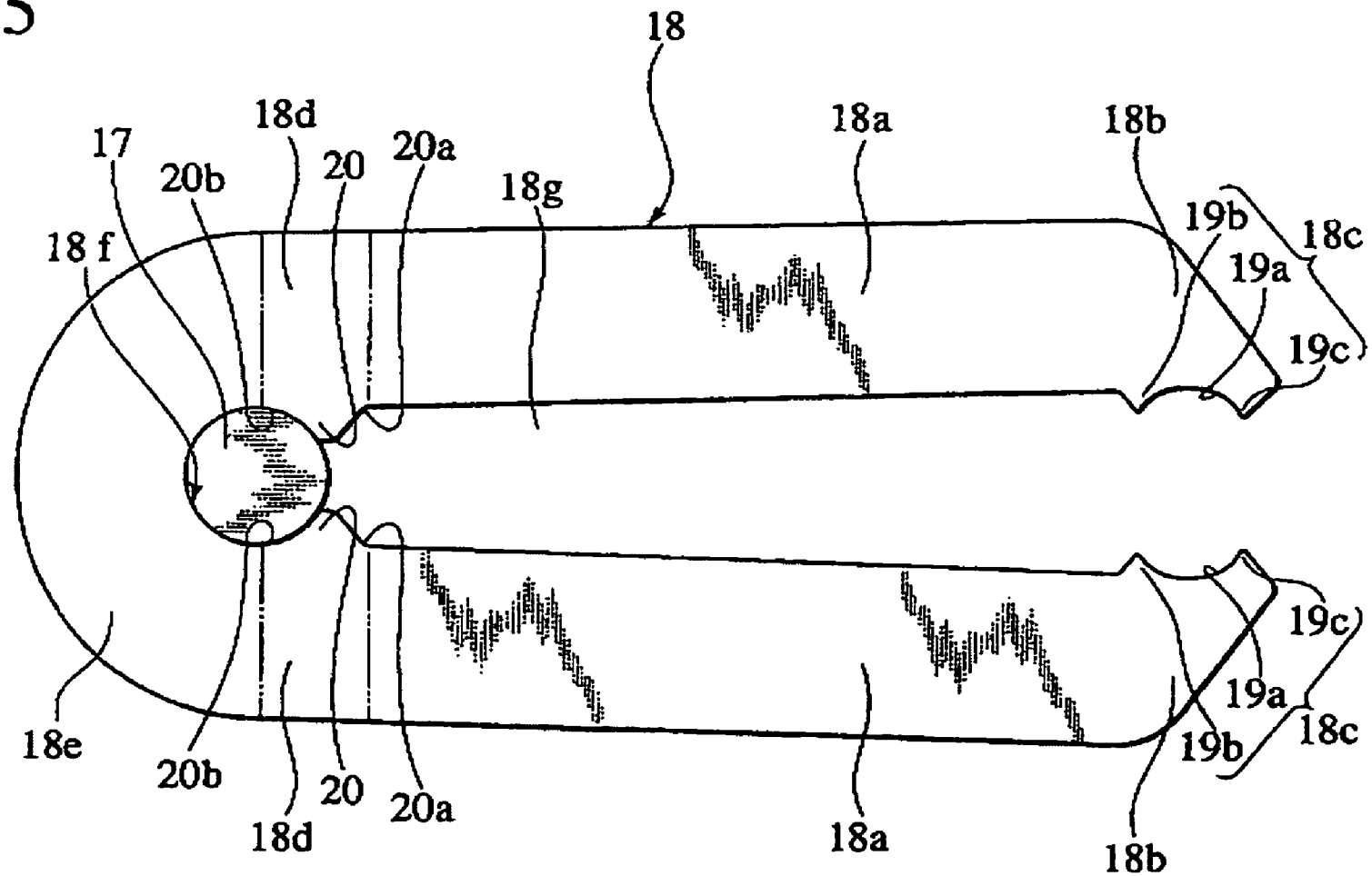
FIG. 25 is a plan view of a coupling member relating to another embodiment of the present invention.
Figure 26:
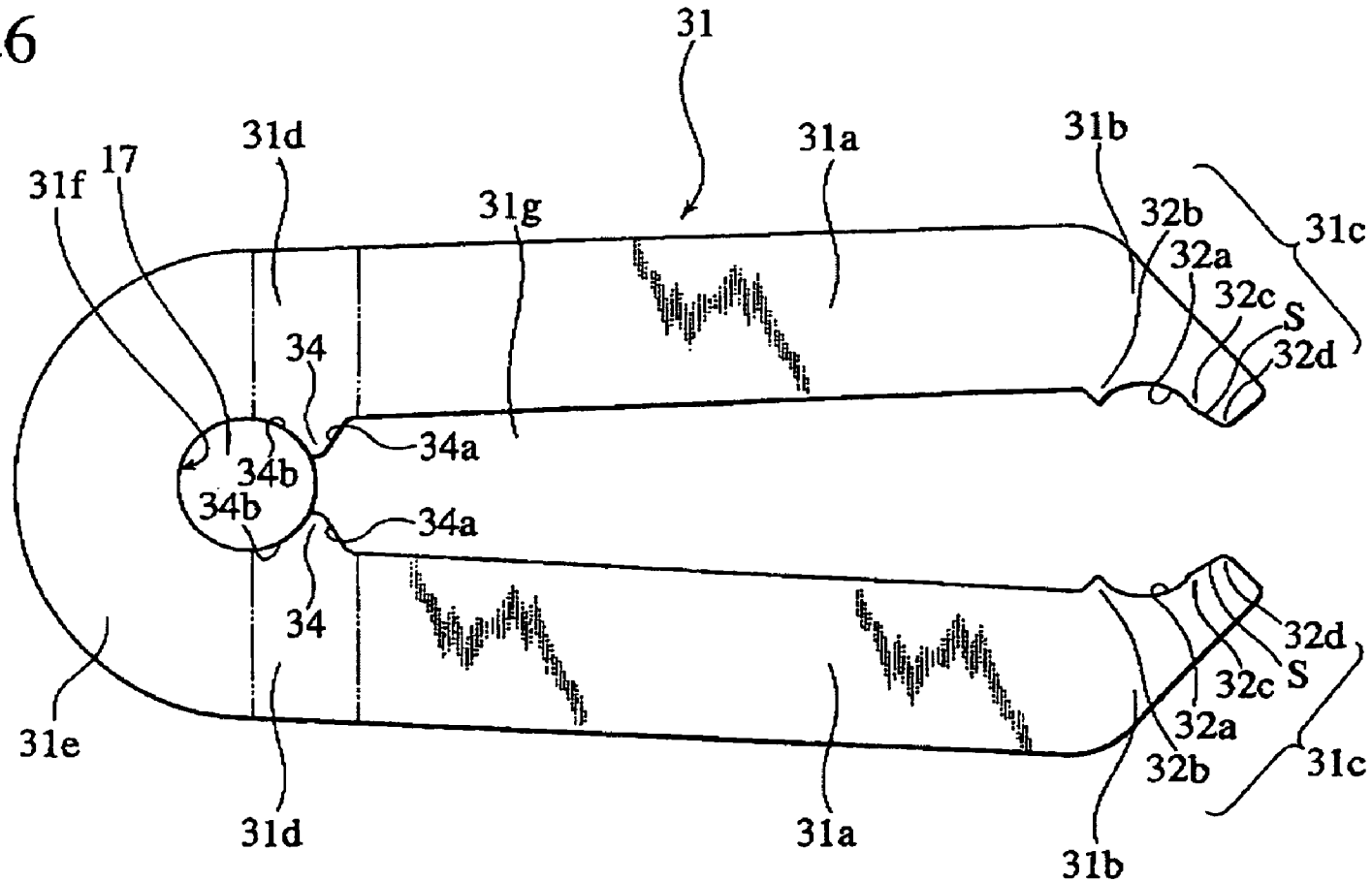
FIG. 26 is a plan view of a coupling member relating to another embodiment of the present invention.

Moreover, as illustrated in FIG. 25, the coupling member 18 may be made of a plastically deformable material. Accordingly, the coupling member 18 can be more miniaturized than the case where the coupling member 18 is elastically deformed when the first pin 14 is released from the coupling member 18. Therefore, miniaturization of the whole device will be realized and design will also be easier.

Further, in the above release process, force (pull-out load) acting from the first pin 14 to the coupling member 18 may be maximized when the coupling member 18 crosses at 85° to 95° to the radial direction of the pulley 13 and the hub 15.

Second Embodiment

Referring to FIGS. 15 to 19, the second embodiment will be described below. The same members as those in the constitution of the first embodiment are given the same numerals. The second embodiment is different from the first embodiment in the constitution of the coupling member.

A coupling member 31 is made of bearing steel material such as SUJ, and is of a forked leaf spring which is substantially U-shaped. A manufacturing method of the coupling member 31 is the same as the manufacturing method of the coupling member 18.

Figure 15:
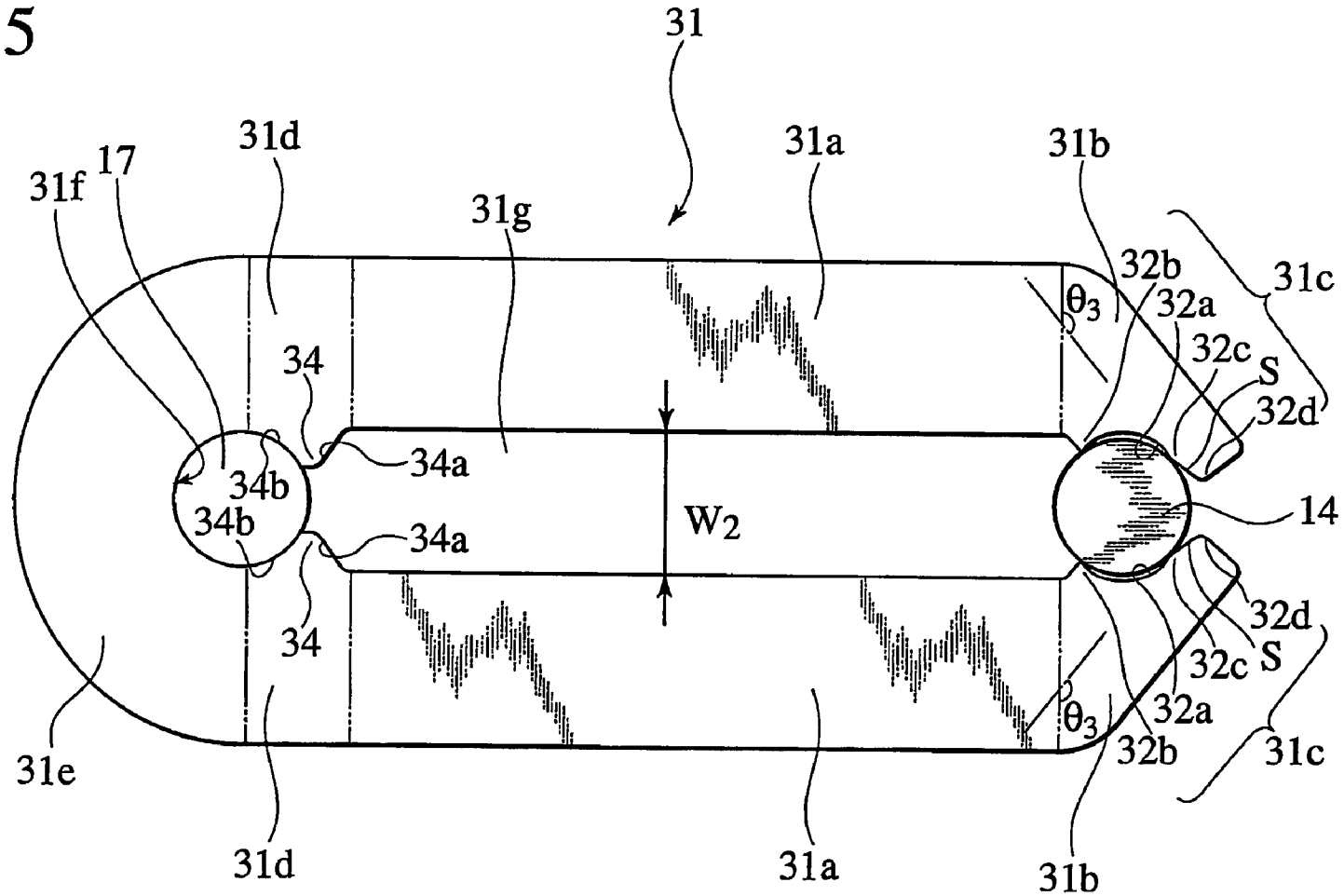
FIG. 15 is a plan view of a coupling member relating to a second embodiment of the present invention.

The coupling members 31 are arranged between the pulley 13 and the hub 15 so as to cross at an acute angle to the radial direction of the pulley 13 and the hub 15. As shown in FIG. 15, the coupling member 31 has a pair of sidepiece portions 31*a*, a pair of bent portions 31*b*, a pair of holding portions 31*c*, a pair of joining portions 31*d*, a curved portion 31*e*, a through-hole 31*f* and a spacing 31*g*. The first pin 14 inserted into the pin-insertion hole 13*e* is held by the holding portions 31*c*, 31*c*. The second pin 17 inserted into the pin-insertion hole 15*a* is fitted into the through-hole 31*f*.

The sidepiece portions 31*a*, 31*a* are formed in the shape of a rectangle and are disposed parallel to each other.

Figure 16:
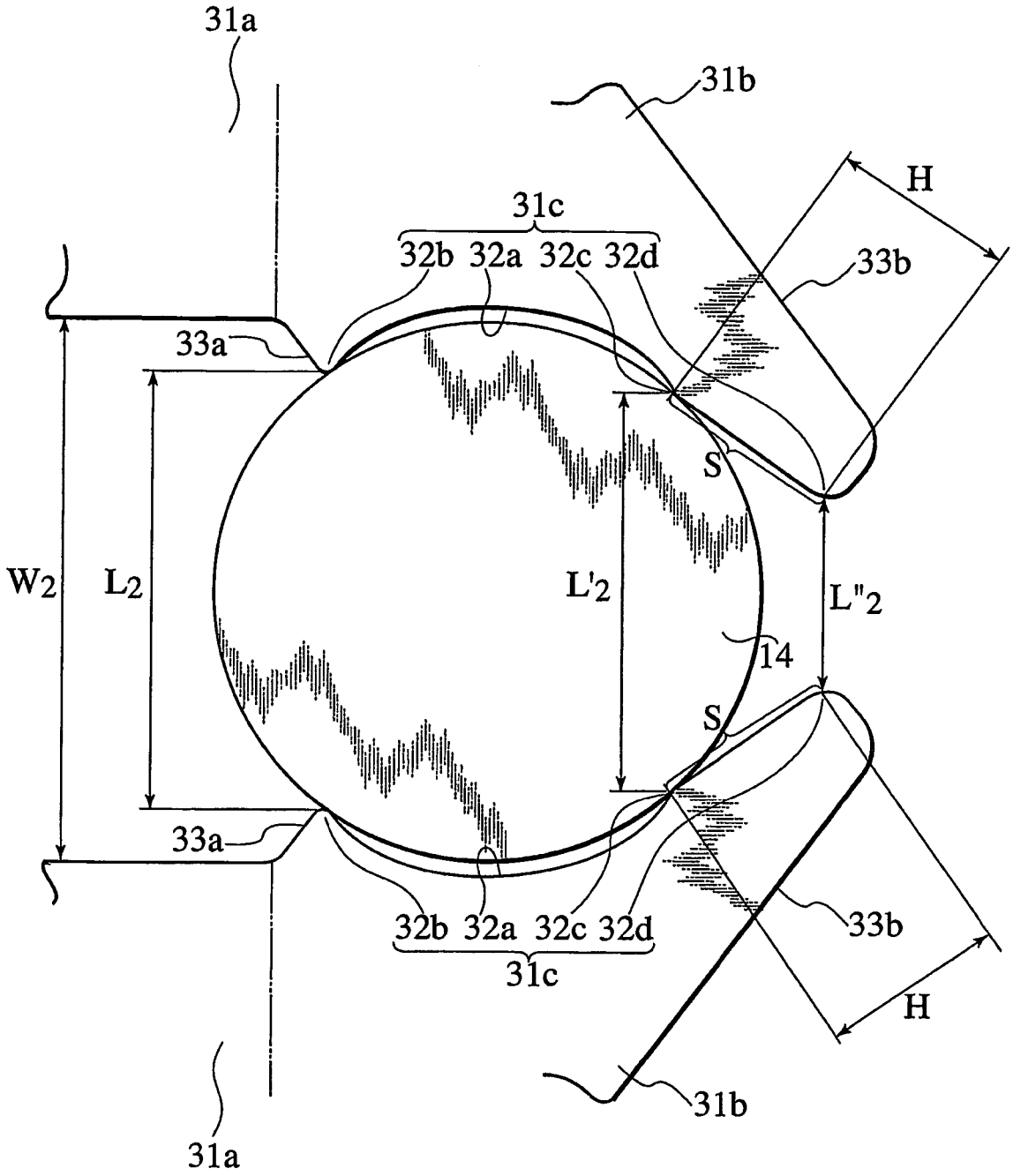
FIG. 16 is an enlarged plan view of the main portion of FIG. 15.

The bent portions 31*b*, 31*b* are bent at a given angle θ3 to the sidepiece portions 31*a*, 31*a*, and are configured to extend from first ends of the sidepiece portions 31*a*, 31*a* respectively, so as to come close to each other. The bent portions 31*b*, 31*b* have inside surfaces 32*a*, 32*a*, first projections 32*b*, 32*b*, second projections 32*c*, 32*c*, third projections 32*d*, 32*d* and holding surface S, S, respectively. Curvature of each inside surface 32*a* is larger than that of the first pin 14. It should be noted that the curvature of each inside surface 32*a* may be equal to or less than that of the first pin 14 if the inside surface 32*a* does not contact with the outside circumferential surface of the first pin 14. The inside surface 32*a* is formed on a basic end side (the sidepiece portion 31*a* side) of the bent portion 31*b*. The first projection 32*b* and the second projection 32*c* are provided at both end portions of the inside surface 32*a*, and are formed in the round shape. In the bent portion 31*b*, the distance between the first projection 32*b* and the second projection 32*c* is equal to that between the first projection 19*b* and the second projection 19*c* of the first embodiment. The third projection 32*d* is provided at a free end side of the bent portion 31*b*, and joined integrally to the second projection 32*c* via the holding surface S. As shown in FIG. 16, an inside surface 33*a* and an outside surface 33*b* of the bent portion 31*b* is substantially parallel to each other.

With regard to a pair of the bent portion 31*b*, the first projection 32*b*, the second projection 32*c* and the third projection 32*d* of one bent portion 31*b* are respectively opposite to the first projection 32*b*, the second projection 32*c* and the third projection 32*d* of the other bent portion 31*b* at a given distance from each other. A distance L2 between the first projections 32*b*, 32*b* is larger than a distance L2' between the second projections 32*c*, 32*c*. A distance L2" between the third projections 32*d*, 32*d* is smaller than the distance L2'.

The holding portions 31*c*, 31*c* is formed by the inside surfaces 32*a*, 32*a*, the first projections 32*b*, 32*b*, the second projections 32*c*, 32*c*, the third projections 32*d*, 32*d* and the holding surfaces S, S. In a state where the holding portions 31*c*, 31*c* support the first pin 14 by sandwiching, the first projections 32*b*, 32*b* and the second projections 32*c*, 32*c* are point-contacted with the outside circumferential surface of the first pin 14 in the plan view of the coupling member 31, and line-contacted with the outside circumferential surface of the first pin 14 in the cross-section view of the coupling member 31. Also, the outside circumferential surface of the first pin 14 is opposite to the inside surfaces 32*a*, 32*a* at a given distance from the inside surfaces 32*a*, 32*a*.

The holding surface S is configured to extend linearly in the tangential direction of the outside circumferential surface of the first pin 14 contacted with the second projection 32*c*. In a release process, the first pin 14 slides on the holding surface S having a slidable distance H. Additionally, the holding surface S may be configured to curved inward of the holding portions 32*c*, 32*c* gently from the outside circumferential surface of the first pin 14 contacted with the second projection 32*c*.

As shown in FIG. 15, the joining portions 31*d*, 31*d* are configured to extend from second ends of the sidepiece portions 31*a*, 31*a*, and arranged to be parallel to each other. The curved portion 31*e* is formed in the shape of a semicircular ring. The second end of one sidepiece portion 31*a* is joined integrally to the first end of the curved portion 31*e* via one joining portion 31*d*. And, the second end of the other sidepiece portion 31*a* is joined integrally to the second end of the curved portion 31*e* via the other joining portion 31*d*.

Protrusions 34, 34 are formed on the inside surfaces of the joining portions 31*d*, 31*d*, respectively. One protrusion 34 is opposite to the other protrusion 34 at a given distance from the other protrusion 34. A first slant 34*a* of the protrusion 34 positioned on the sidepiece portion 31*a* side is convex outward, and a second slant 34*b* of the protrusion 34 positioned on the curved portion 31*e* side are concave inward. Each of the second slants 34*b* is smoothly joined to the inside surface of the curved portion 31*e*. In the plan view of the coupling member 31, both the second slants 34*b*, 34*b* and the inside surface of the curved portion 31*e* are located on the same circumference.

The through-hole 31*f* is formed by the second slants 34*b*, 34*b* of the joining portions 31*d*, 31*d* and the inside surface of the curved portion 31*e*. The second pin 17 is passed through and fitted into the through-hole 31*f*.

The spacing 31*g* is formed between the sidepiece portions 31*a*, 31*a*, and between the first slants 34*a*, 34*a* of the protrusions 34, 34 of the joining portions 31*d*, 31*d*. The distance W2 of the spacing 31*g* is larger than the distances L2, L2', L2" and slightly larger than a diameter of the first pin 14. Hollow portions of the holding portion 31*c*, 31*c* and the through-hole 31*f* are communicated with the spacing 31*g*.

In the following, functions of the coupling member 31 will be described.

Once burn-in occurs in the interior of the compressor 1, the rotary shaft 4 stops rotating. Consequently, the hub 15 also stops rotating, and therefore the numbers of revolutions of the pulley 13 and the hub 15 come to differ from each other, resulting in that a torque load is applied onto the coupling member 31. When the torque load exceeds the given value, the first pin 14 deforms the whole coupling member 31 elastically to broaden the distance L2' between the holding portions 31*c*, 31*c* through pressing the second projections 32*c*, 32*c* by means of the outside surface thereof as the pulley 13 rotates. Further, when the pulley 13 rotates, the first pin 14 moves on the holding surfaces S, S toward free ends side of the holding portions 31*c*, 31*c* to broaden the distance between the holding surfaces S, S, and then the first pin 14 will be released from the coupling member 31 after the distance L2" is equal to the diameter of the first pin 14. At this time, the coupling member 31 crosses at about right angle to the radial direction of the pulley 13 and the hub 15. Through the above mechanism, the power transmission from the pulley 13 to the rotary shaft 4 is cut off, and the pulley 13 will run idle.

In the following, in order to explain time-change of force acting from the first pin 14 to the coupling member 31 in the above release process, described will be the case where force F acts axially on the coupling member 31 in a state where the first pin 14 is sandwiched between the holding portions 31*c*, 31*c*.

Figure 17B:
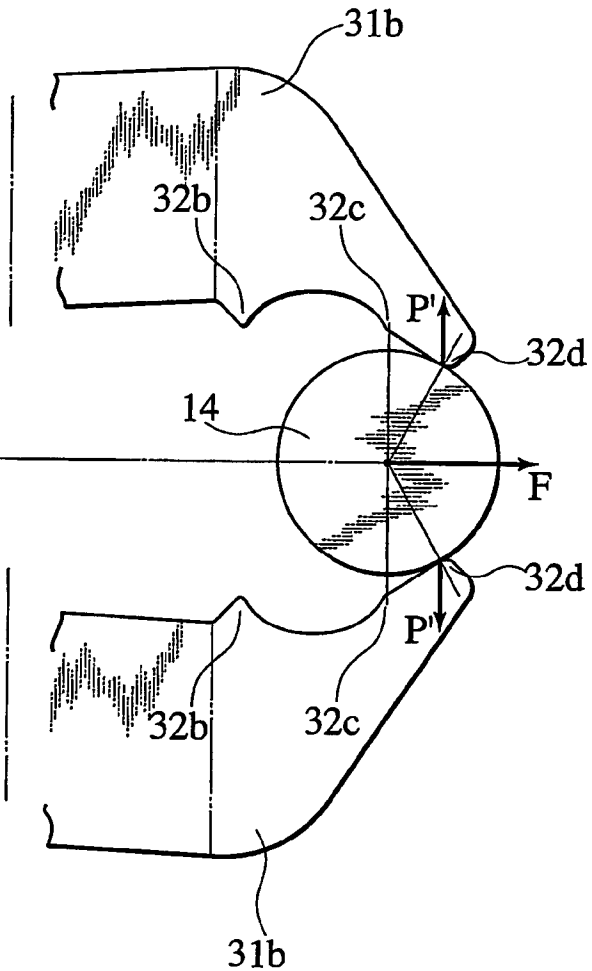
FIG. 17B is an explanatory view showing a pull-out load applied to the coupling member relating to the second embodiment of the present invention when the first pin is located on third projections of the holding potions.
Figure 17A:
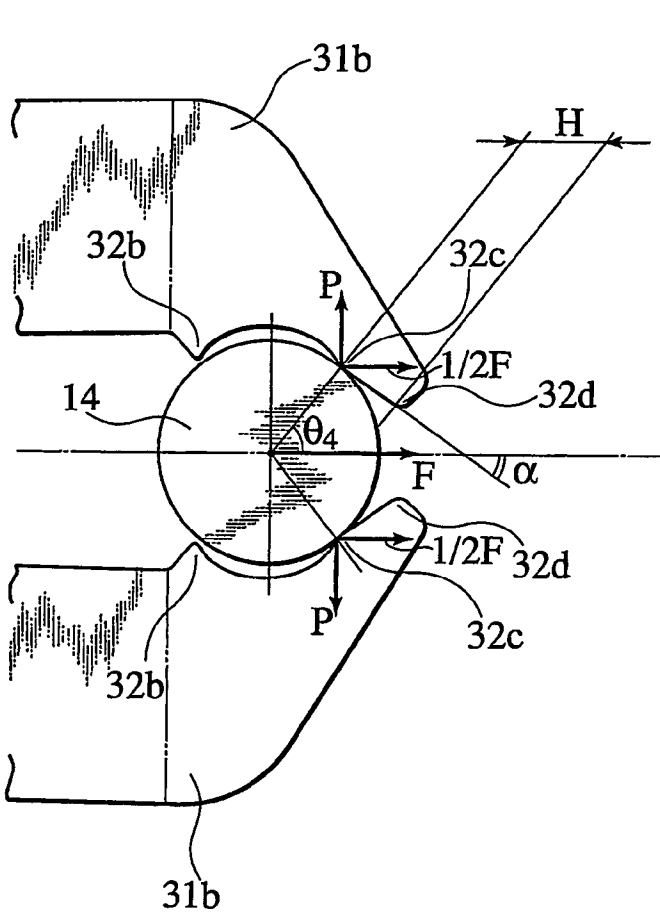
FIG. 17A is an explanatory view showing a pull-out load applied to the coupling member relating to the second embodiment of the present invention when a fist pin is located on second projections of holding portions.

As shown in FIG. 17A, if the force F acts on the first pin 14, the first pin 14 is apart from the first projections 32*b*, 32*b* and pressed against the second projections 32*c*, 32*c*. At this time, reaction forces P, P from the second projections 32*c*, 32*c* act on the first pin 14.

As shown in FIG. 17B, if the force F increases, the first pin 14 is apart from the second projections 32*c*, 32*c* and then moves on the holding surfaces S, S while broadening the distance between the holding surfaces S, S. if the force F further increases, the first pin 14 is pressed against the third projections 32*d*, 32*d*. At this time, reaction forces P", P' from the third projections 32*d*, 32*d* act on the first pin 14.

In a state where the force F acts on the first pin 14, the following relationship holds: P=½F tan θ4, that is F=2P/tan θ4. Assuming that there is not friction resistance, the above relationship holds. Accordingly, in order to keep the force F constant, it is necessary to meet the following conditions: P'<P and L2'>L2". Additionally, in consideration of the friction resistance, the value of the reaction forces P, P' can be changed by modifying slightly an angle α to the axial direction of the coupling member 25.

Next, shown will be measured data of a pull-out load applied from the first pin 14 to the coupling member 31 (or 18) under the condition that the first pin 14 is pulled outward at a constant speed by acting force F axially on the coupling member 31 (or 18) after coupling the first pin 14 and the second pin 17 with the coupling member 31 (or 18) independently.

Figure 18A:
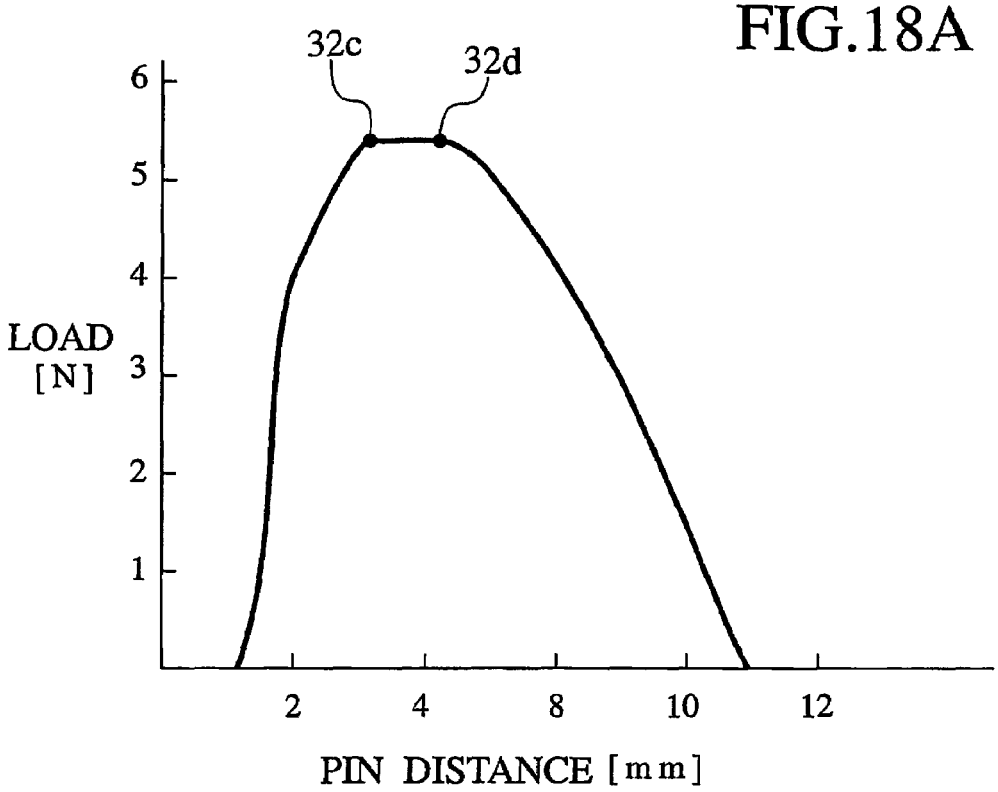
FIG. 18A is a graph showing load-characteristics of the coupling member relating to the second embodiment of the present invention.

As shown in FIG. 18A, the maximum pull-out load on the first pin 14 for the coupling member 31 is about 55N and is continuously generated in the region from the second projection 32*c* to the third projection 32*d*. The first pin 14 is released from the coupling member 31 when the pin distance has about 11 mm.

Figure 18B:
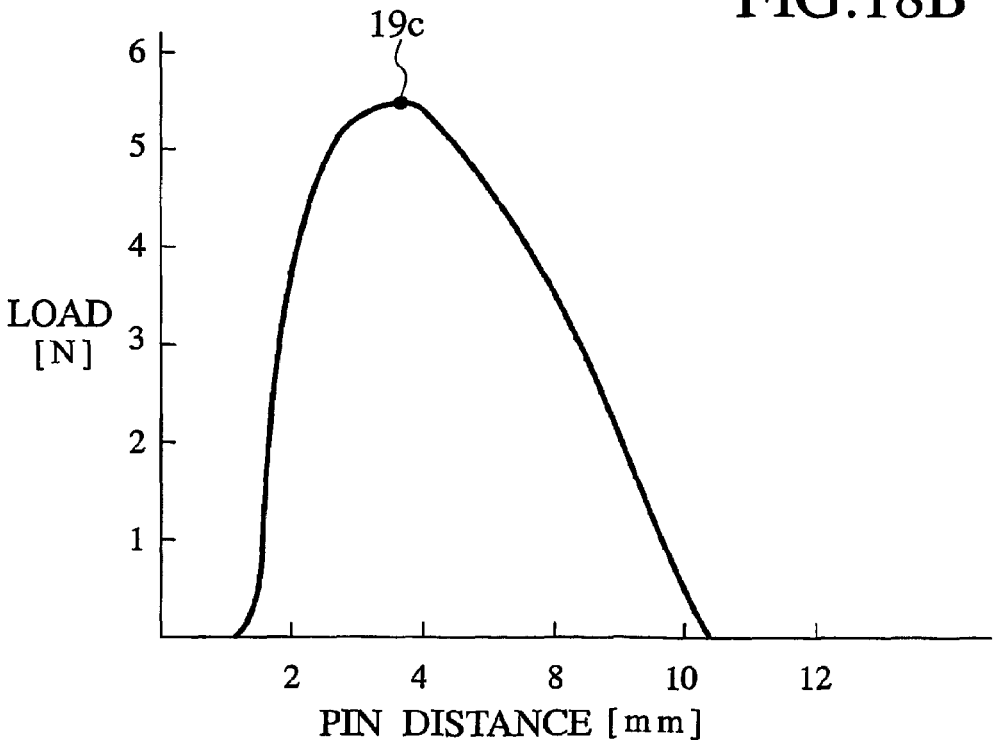
FIG. 18B is a graph showing load-characteristics of the coupling member relating to the first embodiment of the present invention.

As shown in FIG. 18B, the maximum pull-out load on the first pin 14 for the coupling member 18 is about 55N and is only generated near the second projection 19*c*. The first pin 14 is released from the coupling member 18 when the pin distance has about 10.5 mm.

Therefore, the coupling member 31 remains nearly unaffected by noise to stabilize the release process because the coupling member 31 needs impulse above a certain value in order to release the first pin 14 from the coupling member 31.

The coupling member 31 has the following features.

Since the coupling member 31 is made of bearing steel, it has wear resistance, resiliency and excellent tensile strength.

When the torque load exceeds the given value, the first pin 14 will slide on the holding surfaces S, S as the pulley 13 rotates. During this sliding motion, the first pin 14 generates the maximum pull-out load keeping a constant value to deform the coupling member 31 via the holding portions 31*c*, 31*c*. Therefore, the coupling member 31 needs impulse above a certain value in order to release the first pin 14 from the holding portions 31*c*, 31*c*, which stabilizes the release process without being affected by noise.

Further, since the contact area between the first pin 14 and the coupling member 31 in the power-transmission cutoff member of the present embodiment is smaller than a contact area between a rolling ball and a buffer rubber in a conventional power-transmission cutoff member and is slightly larger than a contact area between the first pin 14 and the coupling member 18 in the conventional power-transmission cutoff member of the first embodiment, preventing the pull-out load from being affected by the age-degradation of the coupling member 31. Therefore, power transmission is always cut off at a constant torque load.

Since each of the coupling members 31 is arranged at a regular angle apart from the adjacent ones 31, torque loads applied on the coupling members 31 are equal to one another. Therefore, power transmission is always cut off at a constant torque load. As a result, if the torque load required for cutting off power transmission has tolerance, the tolerance can be passed to members except for the coupling members 31.

In the following, a first to a fourth modification of the present embodiment will be described.

(First Modification)

Figure 19:
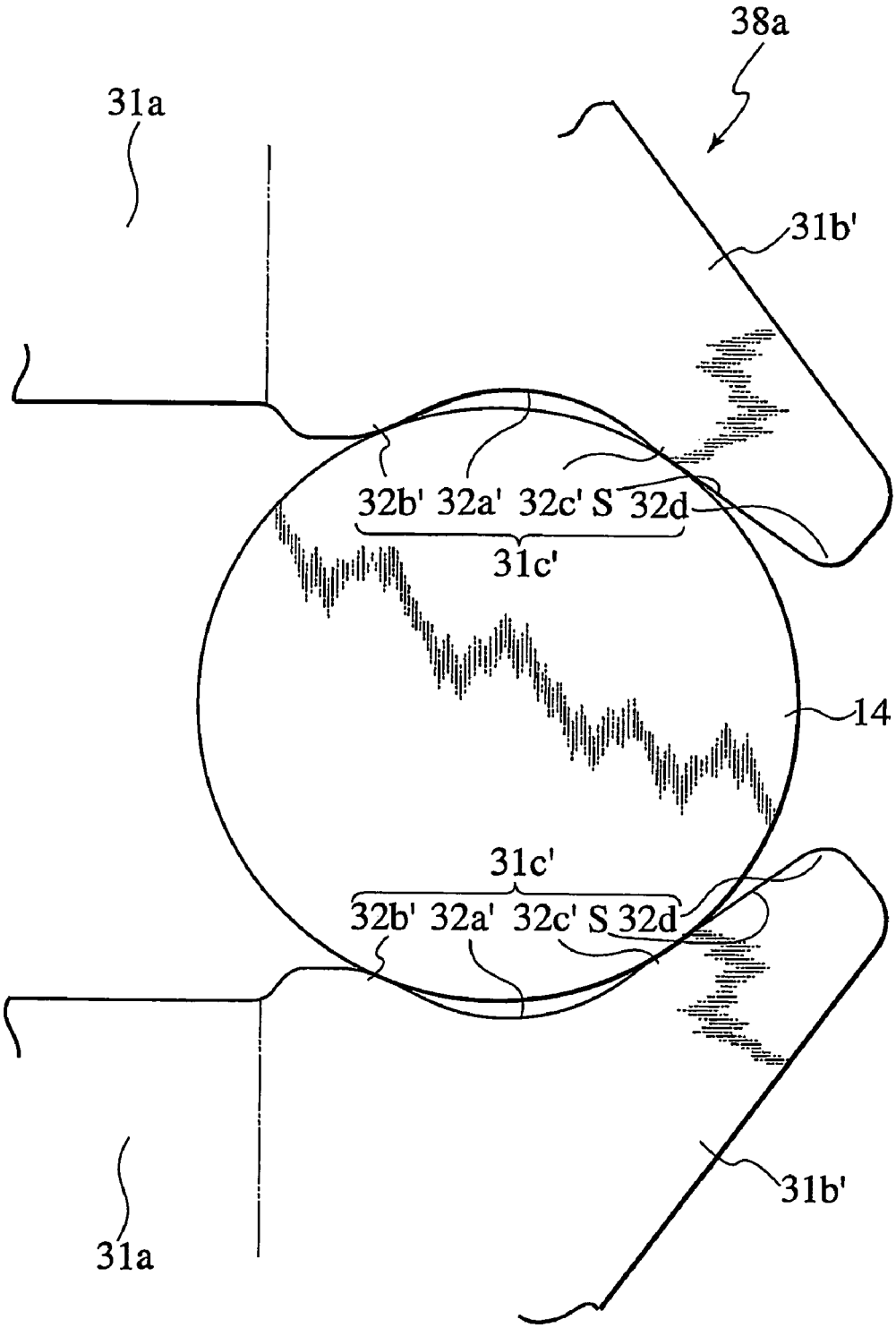
FIG. 19 is an enlarged plan view of the main portion of a coupling member relating to a first modification of the second embodiment of the present invention.

As shown in FIG. 19, holding portions 31*c*', 31*c*' of a coupling member 38*a* is formed by inside surfaces 32*a*', 32*a*', first projections 32*b*', 32*b*', second projections 32*c*', 32*c*', the third projections 32*d*, 32*d* and the holding surfaces S, S. Curvature of each inside surface 32*a*' is larger than that of the first pin 14. The first projection 32*b*' and the second projection 32*c*' are provided at both end portions of each inside surface 32*a*'. Curvatures of the first projection 32*b*' and the second projection 32*c*' are smaller than those of the first projection 32*b* and the second projection 32*c*. According to the above constitution, since contact area between the first pin 14 and the coupling member 38*a* is slightly larger than that between the first pin 14 and the coupling member 31, the first pin 14 can be securely sandwiched by the holding portions 31*c*', 31*c*'.

(Second Modification)

Figure 20:
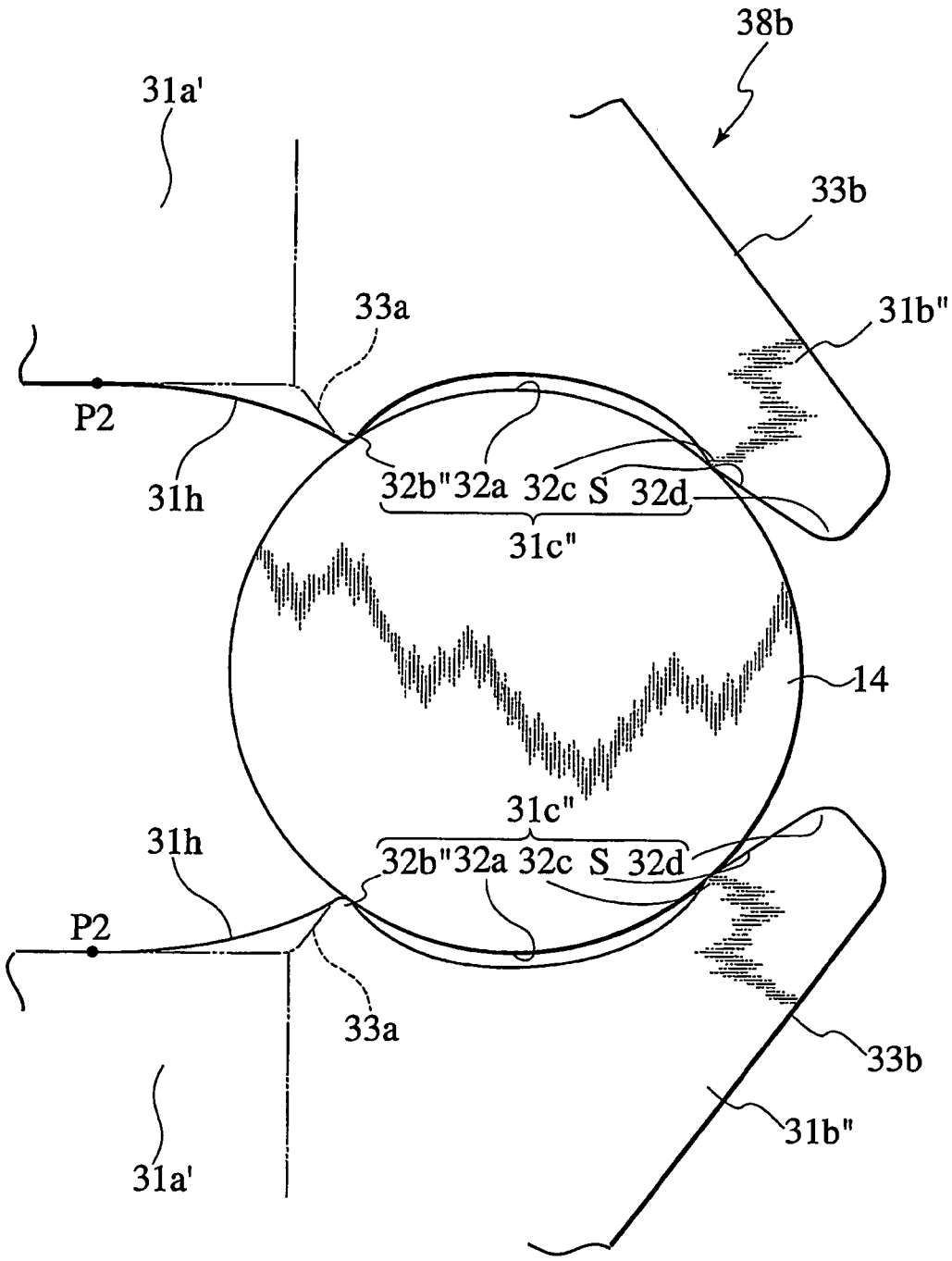
FIG. 20 is an enlarged plan view of the main portion of a coupling member relating to a second modification of the second embodiment of the present invention.

As shown in FIG. 20, in a sidepiece portion 31*a*' and a bent portion 31*b*" of a coupling member 38*b*, a first projection 32*b*' is smoothly jointed to the inside surface of the sidepieces portion 31*a*'. Concretely, a slope 31*h* is formed gently from the given position P2 on the open end side of the inside surface of the sidepiece portion 31*a*' to the top of the first projection 32*b*". According to the above constitution, when the first pin 14 is coupled to the coupling member 38*b*, the first pin 14 is inserted between holding portions 31*c*", 31*c*" under the guidance of the slopes 31*h*, 31*h* as the pulley 13 rotates. Therefore, operation of coupling the first pin 14 to the coupling member 38*b* can be simply performed.

(Third Modification)

Figure 21:
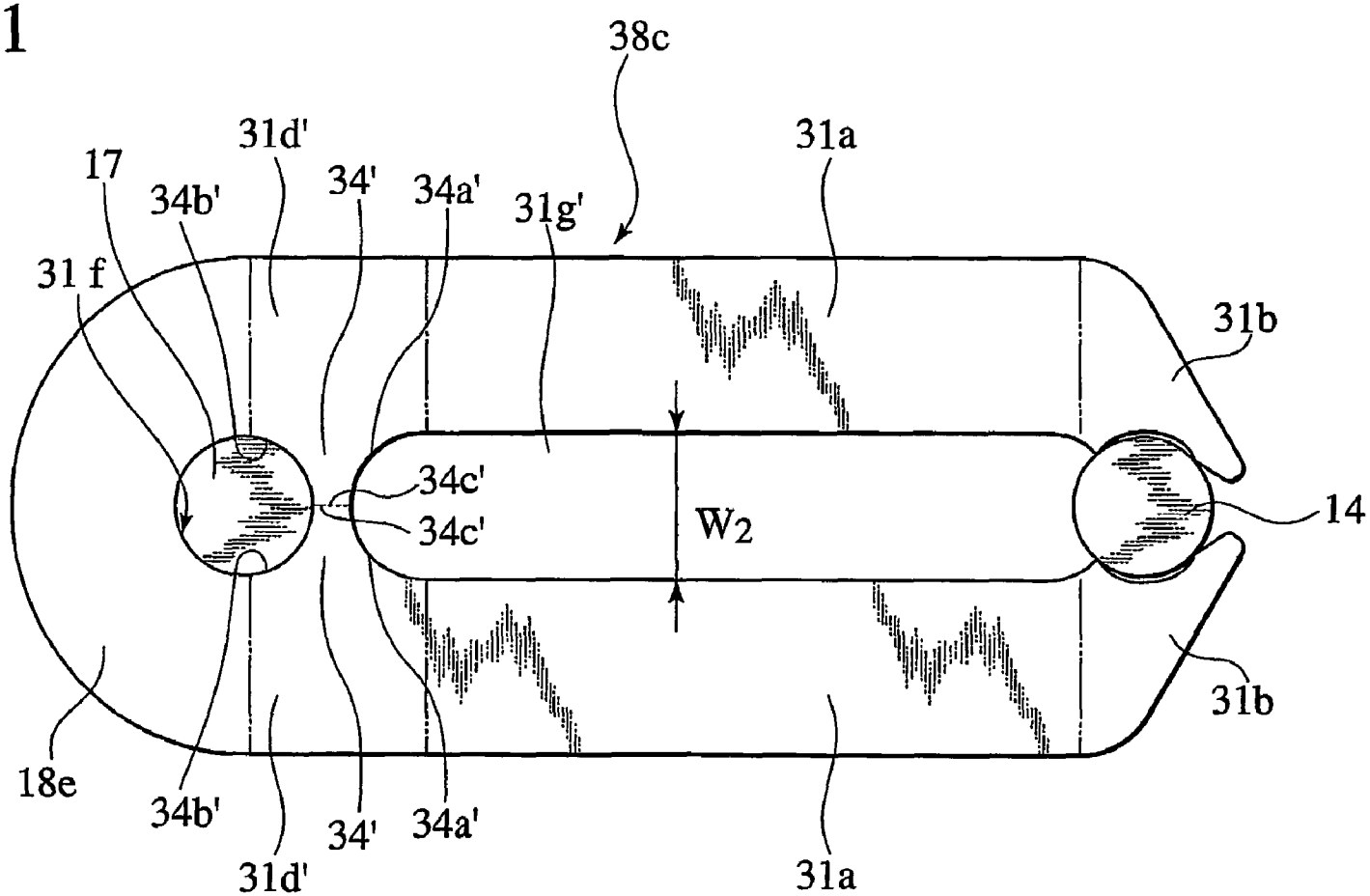
FIG. 21 is a plan view of a coupling member relating to a third modification of the second embodiment of the present invention.

As shown in FIG. 21, a through-hole 31*f*' is disposed separately from a spacing 31*g*' by joining protrusions 34', 34' together of joining portions 31*d*', 31*d*' of a coupling member 38*c*. Each protrusion 34' has a first slant 34*a*', a second slant 34*b*' and a flat surface 34*c*'.

The first slants 34*a*, 34'*a* are joined to each other and also joined to inside surfaces of sidepiece portions 31*a*, 31*a*, respectively. The first slants 34'*a*, 34'*a* form a semicircle with a diameter, W2. The second slants 34*b*', 34*b*' are joined to each other and also joined to an inside surface of a curved portion 31*e*. In the plan view of the coupling member 38*c*, the through-hole portion 31*f*' is formed by the second slants 34*b*', 34*b*' and the inside surface of the curved portion 31*e* to be isolated from the spacing 31*g*'. The flat surfaces 34*c*', 34*c*' are disposed parallel to the axial direction of the coupling member 38*c* and are joined together. Each flat surface 34*c*' connects the first slant 34*a*' to the second slant 34*b*'. According to the above constitution, releasing of the second pin 17 from coupling member 38*c* can be securely avoided.

(Fourth Modification)

With regard to a spacing 31*g* of the coupling member 31, the width W2 of the spacing 31*g* is larger than the distance L2, L2' and also larger than the diameter of the first pin 14. According to the above constitution, the first pin 14 can be easily inserted into the spacing 31*g* when the first pin 14 is coupled with the coupling member 31. Therefore, operation of coupling the first pin 14 to the coupling member 31 can be simply performed.

Other than the above modifications, various modifications can be carried out without departing from the essential characteristics of the present invention.

For example, the first pin 14 sandwiched between the holding portions 31*c*, 31*c* may be disposed in the hub 15, and the second pin 17 passed through and fitted into the through-hole 31*f* of the coupling member 31 may be disposed in the pulley 13.

Moreover, as illustrated in FIG. 25, the coupling member 31 may be made of a plastically deformable material. Accordingly, the coupling member 31 can be more miniaturized than the case where the coupling member 31 is elastically deformed when the first pin 14 is released from the coupling member 31. Therefore, miniaturization of the whole device will be realized and design will also be easier.

Further, in the above release process, force (pull out load) acting from the first pin 14 to the coupling member 31 may be maximized when the coupling member 31 crosses at 85° to 95° to the radial direction of the pulley 13 and the hub 15.

Third Embodiment

Figure 22:
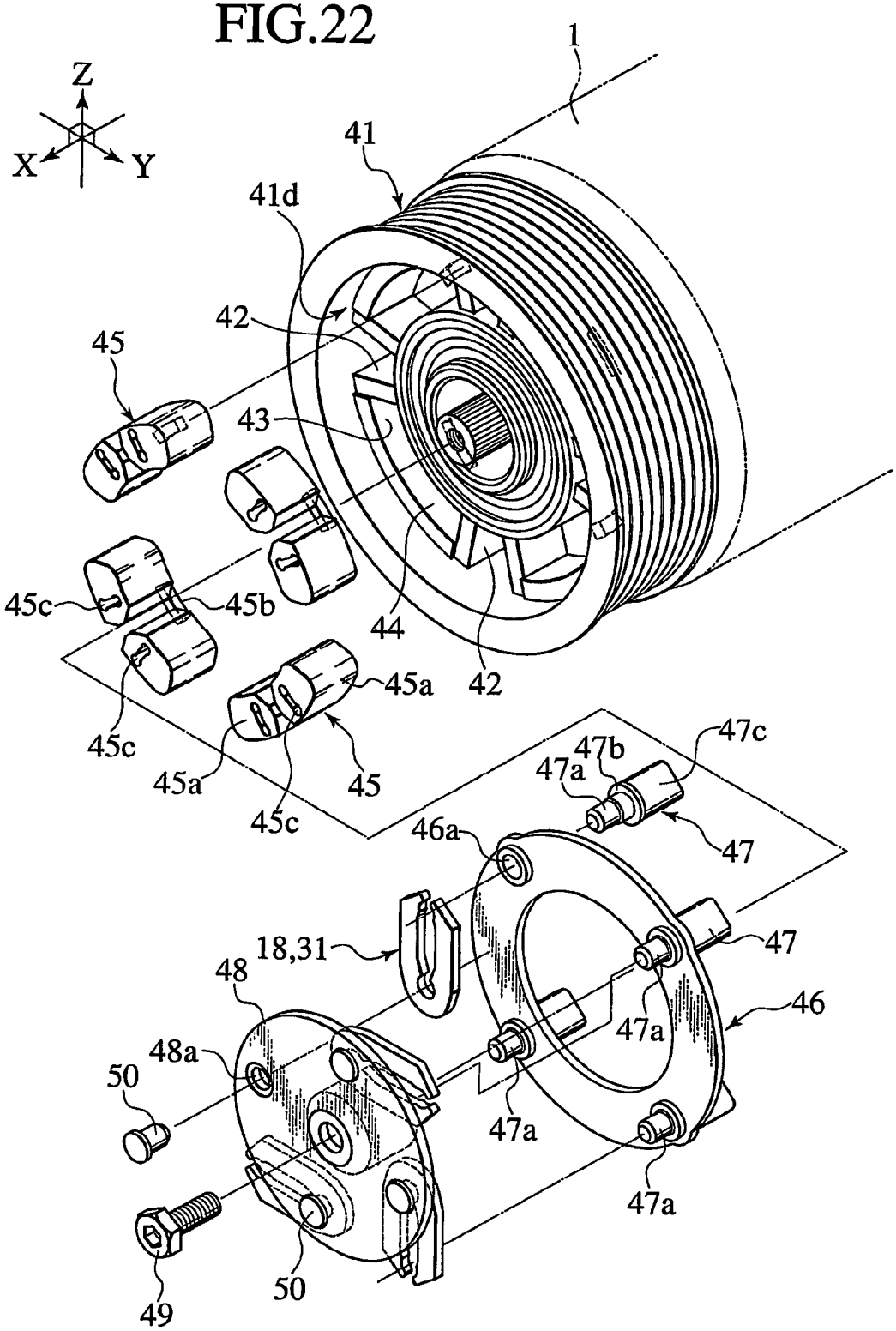
FIG. 22 is an exploded perspective view of a power transmission device relating to a third embodiment of the present invention.
Figure 23:
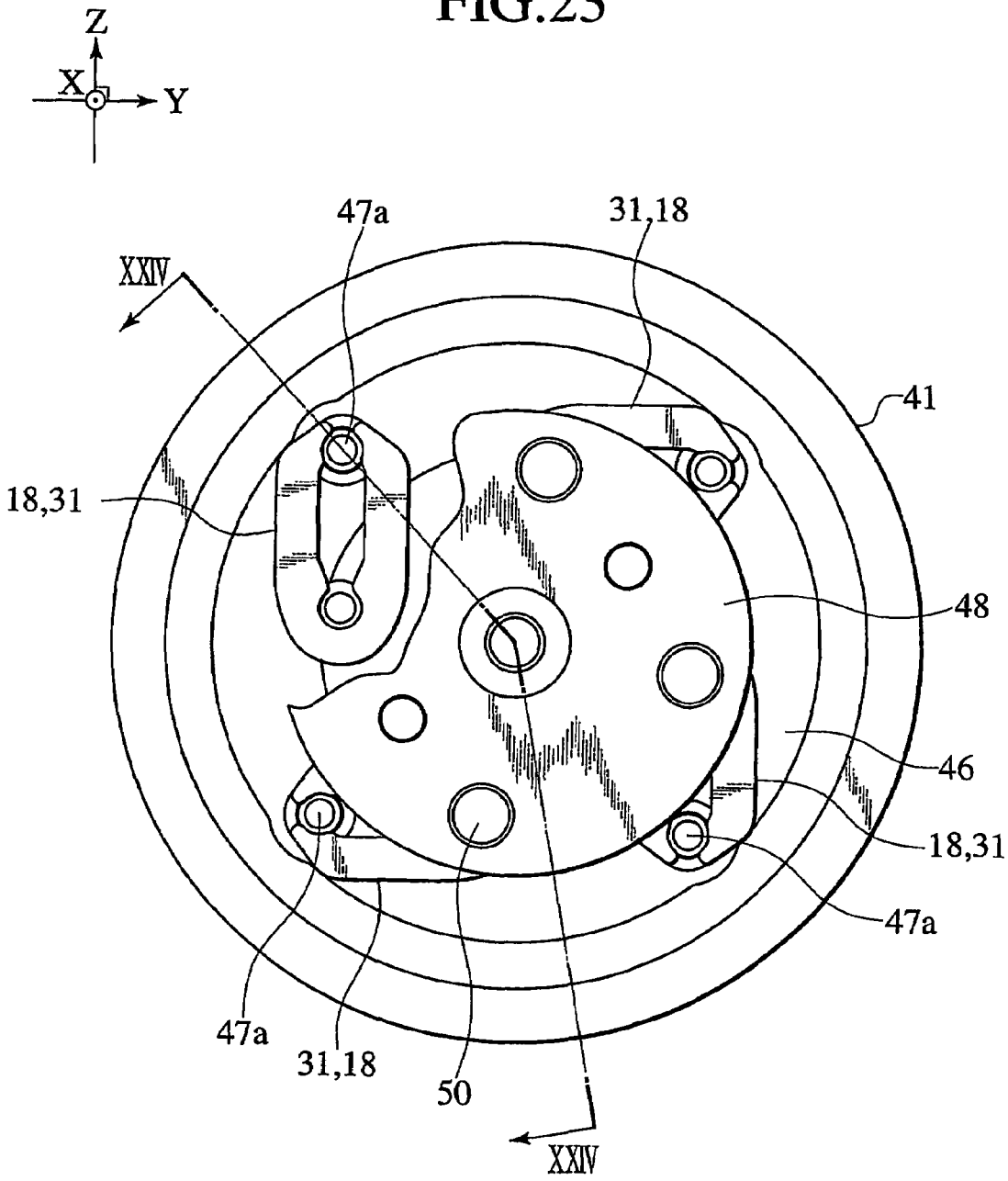
FIG. 23 is a side view of the main portion of the power transmission device relating to the third embodiment of the present invention.
Figure 24:
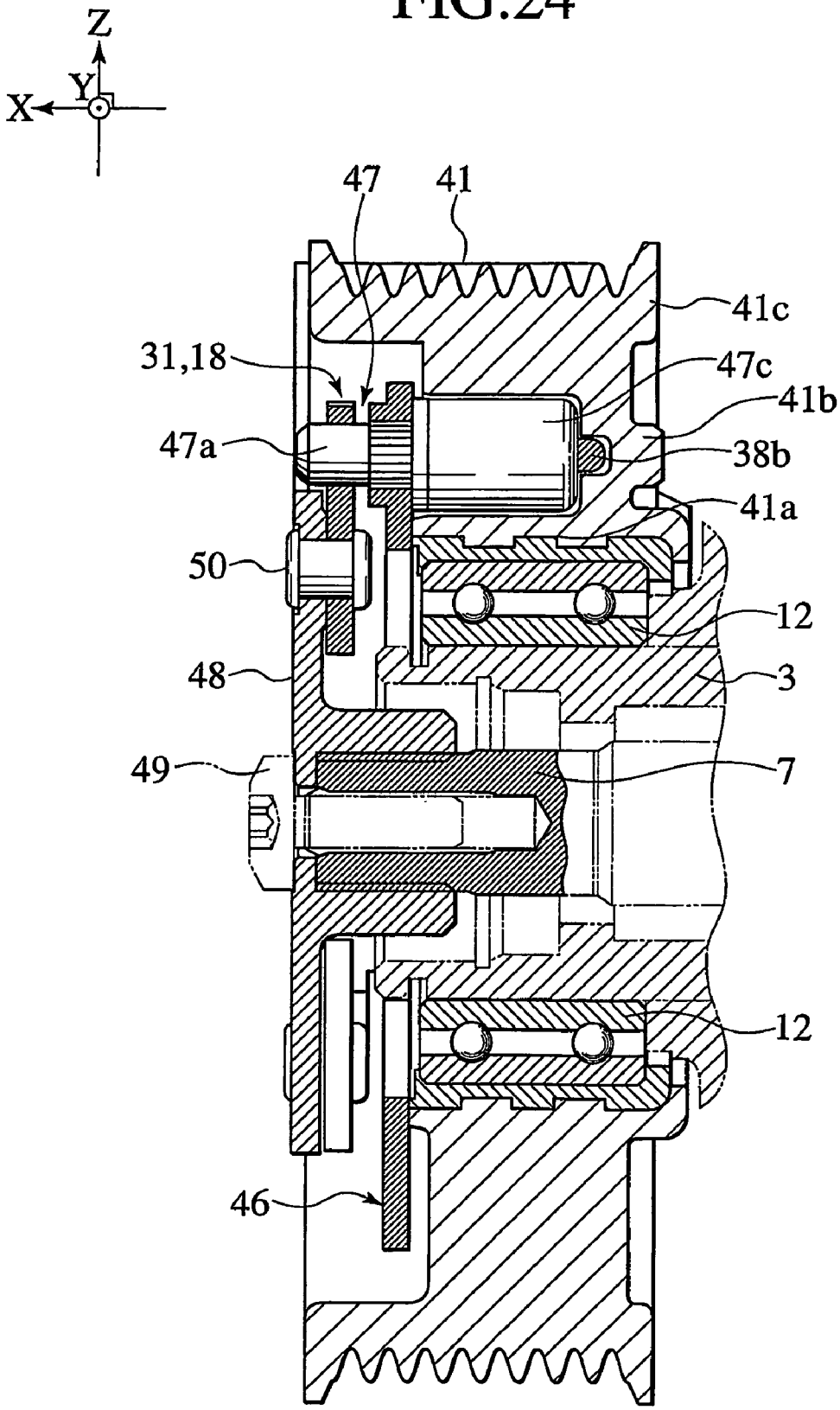
FIG. 24 is a cross-sectional view sectioned along the XXIV-XXIV line in FIG. 23.

Referring to FIGS. 22 to 24, the third embodiment will be described below. The same members as those in the constitution of the first and second embodiment are given the same numerals. The third embodiment is different from the first embodiment in that a coupling member is disposed between a hub and location plate.

As shown in FIG. 24, a pulley 41 is rotatably attached to a boss portion 3 via a bearing 12. The pulley 41 has an inner cylinder portion 41*a*, a joint portion 41*b* and an outer cylinder portion 41*c*. The inner cylinder portion 41*a* is formed in the shape of a cylinder and is coaxial with a rotary shaft 4. The joint portion 41*b* is formed, in the shape of a round ring, integrally on the outside surface of a end portion (−X side) of the inner cylinder portion 41*a* and protrudes outward in the radial direction of the inner cylinder portion 41*a*. The outer cylinder portion 41*c* is formed, in the shape of a cylinder, integrally at the circumferential end of the joint portion 41*b* and is coaxial with the rotary shaft 4. The outer cylinder portion 41*c* has an outside surface on which a plurality of V grooves are formed for winding the belt B on them.

The pulley 41 has an annular recess 41*d* formed by the outside surface of the inner cylinder portion 41*a*, the end surface on the +X side of the joint portion 41*b* and the inside surface of the outer cylinder portion 41*c*. The recess 41*d* is open in the +X direction.

As shown in FIG. 22, the recess 41*d* has a plurality of ribs 42 and step portions 43. The ribs 42 are disposed in the radial direction of the recess 41*d* between an outside circumferential surface of the inner cylinder portion 41*a* and an inside circumferential surface of the outer cylinder portion 41*c*. The step portions 43 are provided, extending by a given length, along the inside circumferential surface of the outer cylinder portion 41*c*. The recess 41*d* has reception spaces 44 each of which is defined by the two ribs 42 and the step portion 43.

A damper 45 has a pair of damper bodies 45*a*, a joining band 45*b* and grooved portions 45*c*, and is received within the reception space 44. The damper 45 is made of an elastic body such as a rubber, a soft resin.

The damper body 45*a* is molded into a block approximately in the shape of a rectangular prism. The joining band 45*b* joins together a pair of the damper bodies 45*a* at each first end portion of the damper bodies 45*a*. The grooved portion 45*c* is formed at the second end portion of each damper body 45*a*. The grooved portion 45*c* increases in flexibility of the damper body 45*a*.

The first end portion side of the damper 45 is received in the reception space 44 and the second end portion side of the damper 45 protrudes outward into an opening of the recess 41*d*.

The location plate 46 is formed in the shape of a round ring and has a plurality of insertion holes 46*a*. The pin insertion holes 46*a* are disposed, on the same circumference with the axis of the location plate 46 as the center, spaced a given angle apart from the adjacent pin insertion holes 46*a*. Additionally, in the present embodiment, four pin insertion holes 46*a* are disposed on the location plate every 90° apart from one another.

A location shaft 47 has a first pin 47*a*, a flange plate 47*b* and a shaft body 47*c*. The first pin 47*a* is formed in the shape of a column. Each of the first pins 47*a* is passed through and fitted into the pin insertion hole 46*a* and is disposed standing upright at an end face on the +X side of the location plate 46. The flange plate 47*b* is provided on an end portion of the first pin 47*a*. The shaft body 47*c* extends from the first pin 47*a* coaxially with the first pin 47*a* and is formed integrally with the first pin 47*a* in the shape of a flat shaft.

The location shaft 47 is coupled with the pulley 41 by inserting the shaft body 47*c* between a pair of the damper bodies 45*a*. Thereby, the location plate 46 is rotated integrally with the pulley 41 via the damper 45 and the location shaft 47.

A hub 48 is fixed to an end portion 4*a* of the rotary shaft 4 with a bolt 49. The hub 48 is coaxial with the rotary shaft 4. Further, the hub 48 has a periphery at which a plurality of pin-insertion holes 48*a* are formed. The pin-insertion holes 48*a* are disposed, on the same circumference with the axis of the hub 48 as the center, spaced a given angle apart from the adjacent ones 48*a*. Additionally, in the present embodiment, four pin-insertion holes 48*a* are disposed at the periphery of the hub 48 every 90° apart from one another.

Second pins 50 are formed approximately in the shape of a column. Each of the second pins 50 is passed through and fitted into the pin-insertion hole 48*a*. As shown in FIG. 22, the second pin 50 is coupled with the first pin 47*a* via the coupling member 31 (or 18). Thereby, the hub 48 is coupled with the location plate 46 via the coupling member 31 (or 18).

In the following, a method of coupling the location shaft 47 and the second pin 50 on the coupling member 31 will be described referring FIG. 22.

First, the second pin 50 is inserted into one of the pin-insertion holes 48*a* of the hub 48. Second, after the end portion of the second pin 50 is inserted into the through-holes 31*f* of the coupling members 31 and washer (not shown), the coupling member 31 is linked with the hub 48 in a caulking manner. Also, the washer may be omitted in the caulking manner. Third, the location shaft 47 is inserted and fixed into one of the insertion holes 46*a* of the location plate 46 and then inserted into the spacing 31*g* of the coupling member 31.

Next, the location shaft 47 is moved toward an open end (the holding portions 31*c*, 31*c*) side of the spacing 31*g* and then coupled on the coupling member 31 by rotating the location plate 46 and the hub 48 relatively. In the case of fastening the location plate 46, the hub 48 is rotated in an anticlockwise direction when viewing in the direction of +X. Then, the location plate 46 and the hub 48 are fixed to the pulley 41 and the end portion 4*a* of the rotary shaft 4, respectively.

Therefore, a method for manufacturing the power transmission device, comprising the steps of fitting plural coupling members 31 to the hub 48, mounting plural location shafts 47 to the location plate 46, inserting each location shaft 47 into the spacing 31*g* of the coupling member 31 and moving each location shaft 47 toward an open end side of the spacing 31*g* to be coupled on the coupling member 31 by rotating the location plate 46 and the hub 48 relatively.

INDUSTRIAL APPLICABILITY

When the number of revolutions of a hub is smaller than the number of revolutions of a pulley and when a torque load exceeding a given value is applied on a coupling member, a first pin is released from the coupling member. At this time, since a contact area between the first pin and the coupling member in a power-transmission cutoff member of the present invention is smaller than a contact area between a rolling ball and a buffer rubber in a conventional power-transmission cutoff member, a force required for releasing the first pin from the coupling member is kept nearly constant. Therefore, the torque load required for cutting off the power transmission to a rotary shaft of a compressor can be maintained at a constant value.

Since, through fitting the first pin and a second pin into a sandwich portion (or a holding portion) and a through hole respectively, assembling operation of a power transmission device is finished, the assembling operation can be performed extremely easier than the conventional assembling operation. Therefore, enhancement of productivity will be accomplished.

The invention claimed is:

1. A coupling member for coupling a driven body with a driving body to transmit driving force of the driving body to the driven body and cutting off the power transmission when a load for driving the driven body exceeds a given value, the coupling member comprising:

a pair of sidepiece portions disposed parallel to each other;

a pair of bent portions having free ends, basic ends joined integrally to first ends of the sidepiece portions respectively and sandwich portions supporting a first pin mounted on one of the driving body and the driven body by sandwiching, wherein each sandwich portion comprises:

two or more projections disposed at regular intervals from one another in a circumferential direction of the first pin and contacted with an outside circumferential surface of the first pin; and one or more surfaces each disposed between the adjacent projections and opposed to the outside circumferential surface of the first pin at a regular distance; and a curved portion having both ends joined integrally to second ends of the sidepiece portions respectively and a hole through and into which a second pin mounted on one of the driving body and the driven body is passed and fitted, wherein the first pin is sandwiched between the sandwich portions by inserting the first pin into a spacing between the sidepiece portions and then pressing the first pin toward the bent portion side to deform the bent portions in a direction away from each other, and wherein the first pin is released from the sandwich portions in a direction of the free end side of the bent portion when the load applied to the first pin exceeds the given value.

2. The coupling member according to the claim 1, wherein each projection is point-contacted with the outside circumferential surface of the first pin in a plan view.

3. The coupling member according to the claim 1, wherein each projection is line-contacted with the outside circumferential surface of the first pin in a cross-sectional view.

4. The coupling member according to the claim 1, wherein a curvature of each surface is larger than that of the first pin in a plan view.

5. The coupling member according to the claim 1, wherein each projection is formed in a round shape in a plan view.

6. The coupling member according to the claim 1, wherein the sidepiece portions, the bent portions and the curved portion all elastically deform when the first pin is being released from the sandwich portions.

7. The coupling member according to the claim 6, wherein at least one of the sidepiece portions, the bent portions and the curved portion has a plastic deformation when the first pin is released from the sandwich portions.

8. The coupling member according to the claim 1, wherein each sandwich portion further comprises a holding surface configured to extend from each projection located on the free end side of the bent portion.

9. The coupling member according to the claim 1, wherein the hole is communicated with the spacing.

10. The coupling member according to the claim 1, wherein the hole is isolated from the spacing.

* * * * *